US007698847B2

(12) United States Patent
Griffin

(10) Patent No.: US 7,698,847 B2
(45) Date of Patent: Apr. 20, 2010

(54) WEAPON GRIP ASSEMBLY

(75) Inventor: Todd Griffin, Miami, FL (US)

(73) Assignee: R/M Equipment, Inc., Miami, FL (US)

( * ) Notice: Subject to any disclaimer, the term of this patent is extended or adjusted under 35 U.S.C. 154(b) by 0 days.

(21) Appl. No.: 12/543,197

(22) Filed: Aug. 18, 2009

(65) Prior Publication Data

US 2009/0313874 A1 Dec. 24, 2009

Related U.S. Application Data

(63) Continuation of application No. 12/277,045, filed on Nov. 24, 2008, now Pat. No. 7,578,089, which is a continuation of application No. 10/566,786, filed as application No. PCT/US2004/003760 on Feb. 10, 2004, now Pat. No. 7,454,858.

(60) Provisional application No. 60/492,509, filed on Aug. 5, 2003.

(51) Int. Cl.
*F41A 23/00* (2006.01)

(52) U.S. Cl. ..... 42/71.01; 42/72; 42/94; 89/37.04

(58) Field of Classification Search ..... 42/71.01, 42/72, 94; 89/37.04
See application file for complete search history.

(56) References Cited

U.S. PATENT DOCUMENTS

| | | | | | |
|---|---|---|---|---|---|
| 1,278,027 | A | * | 9/1918 | Saunders | 42/106 |
| 2,597,565 | A | * | 5/1952 | Gordon et al. | 362/110 |
| 2,639,518 | A | * | 5/1953 | Vida | 434/392 |
| 2,826,848 | A | * | 3/1958 | Davies | 42/71.01 |
| 2,870,683 | A | * | 1/1959 | Wilson | 89/40.06 |
| 2,898,137 | A | * | 8/1959 | Kreske | 403/299 |
| 3,016,802 | A | * | 1/1962 | Grunenberg | 89/40.06 |
| D202,789 | S | * | 11/1965 | Rossi | D22/108 |
| 3,235,997 | A | * | 2/1966 | Stoner | 42/94 |
| 3,235,998 | A | * | 2/1966 | Hadley | 42/94 |
| 3,739,167 | A | * | 6/1973 | Avery | 362/157 |
| 4,397,112 | A | * | 8/1983 | York | 42/94 |
| 4,533,980 | A | * | 8/1985 | Hayes | 362/110 |

(Continued)

OTHER PUBLICATIONS

Civil Docket for Case #: 1:09-cv-20528-DLG (Southern District of Florida (Miami)); RM Equipment, Inc. v. Aex, LLC.

(Continued)

*Primary Examiner*—Michelle Clement
(74) *Attorney, Agent, or Firm*—Nawrocki, Rooney & Sivertson, P.A.

(57) ABSTRACT

A weapon grip assembly for attachment to a forward portion of a weapon is provided. The invention includes a base assembly supported for operative engagement by a handle. The base assembly includes clamps adapted to be secured to a forward portion of the weapon and further includes a post having a clamp end adapted to retain the clamps for pivot motion with respect thereto. The post of the base assembly is received within a bore of the handle, a mandrel being interposed between the handle and the clamps of the base assembly. As the base assembly is drawn into the handle, by rotation of the handle about the post of the base assembly, the mandrel receives the clamp end of the post, with an upper free surface thereof engaging the clamps for pivoted closure about a portion of the weapon in furtherance of securing the weapon grip assembly thereto.

8 Claims, 16 Drawing Sheets

U.S. PATENT DOCUMENTS 4,856,218 A * 8/1989 Reynolds, Jr. ..... 42/146
5,048,215 A * 9/1991 Davis ..... 42/72
5,064,988 A * 11/1991 E'nama et al. ..... 219/121.6
5,068,992 A * 12/1991 Velezis et al. ..... 42/72
5,345,706 A * 9/1994 Brown ..... 42/94
5,440,465 A * 8/1995 Hasness ..... 362/191
5,540,368 A * 7/1996 Oliva ..... 224/271
5,560,703 A * 10/1996 Capps, III ..... 362/110
5,685,105 A * 11/1997 Teetzel ..... 42/146
5,871,272 A * 2/1999 Sharrah et al. ..... 362/184
5,903,995 A * 5/1999 Brubach ..... 42/94
6,023,875 A * 2/2000 Fell et al. ..... 42/146
6,115,952 A * 9/2000 Rigler ..... 42/146
6,315,256 B1 * 11/2001 Tolar ..... 248/230.4
6,622,416 B2 * 9/2003 Kim ..... 42/146
6,655,069 B2 * 12/2003 Kim ..... 42/114
6,658,781 B1 * 12/2003 Bowen ..... 42/71.02
6,671,991 B1 * 1/2004 Danielson ..... 42/114
6,675,521 B1 * 1/2004 Kim ..... 42/114
6,695,267 B2 * 2/2004 Liao ..... 248/175
6,712,485 B2 * 3/2004 Matthews ..... 362/191
6,729,061 B1 * 5/2004 DeJarnette, Jr. ..... 42/71.02
6,785,997 B2 * 9/2004 Oz ..... 42/94
6,851,214 B2 * 2/2005 Oz ..... 42/146
7,032,494 B2 * 4/2006 Wygant ..... 89/37.04
7,111,424 B1 * 9/2006 Moody et al. ..... 42/72
7,121,034 B2 * 10/2006 Keng ..... 42/71.01
7,243,454 B1 * 7/2007 Cahill ..... 42/72
D566,219 S * 4/2008 Moody et al. ..... D22/108
D566,220 S * 4/2008 Moody et al. ..... D22/108
7,409,791 B2 * 8/2008 Moody et al. ..... 42/72
7,412,793 B2 * 8/2008 Moody et al. ..... 42/72
7,421,815 B1 * 9/2008 Moody et al. ..... 42/72
7,430,828 B2 * 10/2008 Munst ..... 42/72
2002/0100204 A1 * 8/2002 Kim ..... 42/146
2003/0202345 A1 * 10/2003 Kim ..... 362/190
2004/0060222 A1 * 4/2004 Oz ..... 42/146
2004/0187274 A1 * 9/2004 Turvey et al. ..... 24/415
2005/0204603 A1 * 9/2005 Larsson ..... 42/146
2005/0241206 A1 * 11/2005 Teetzel et al. ..... 42/72
2006/0064913 A1 * 3/2006 Gablowski et al. ..... 42/72
2006/0277809 A1 * 12/2006 Moody et al. ..... 42/72
2007/0137087 A1 * 6/2007 Florea et al. ..... 42/90
2008/0052979 A1 * 3/2008 Lee et al. ..... 42/94
2008/0141576 A1 * 6/2008 Moody et al. ..... 42/72
2008/0163532 A1 * 7/2008 Moody et al. ..... 42/72
2008/0222936 A1 * 9/2008 Moody et al. ..... 42/73
2009/0000175 A1 * 1/2009 Potterfield et al. ..... 42/94
2009/0038200 A1 * 2/2009 Keng ..... 42/94
2009/0056192 A1 * 3/2009 Oz ..... 42/94
2009/0193702 A1 * 8/2009 Lin ..... 42/72

OTHER PUBLICATIONS

Civil Docket for Case #: 1:09-cv-21728-FAM (Southern District of Florida (Miami)); R/M Equipment. Inc. v. Summit Lake Entertainment, Ltd.

* cited by examiner

WEAPON GRIP ASSEMBLY

This is a continuation of U.S. patent application Ser. No. 12/277,045 filed Nov. 24, 2008, now U.S. Pat. No. 7,578,089, which is a continuation of U.S. patent application Ser. No. 10/566,786 filed Jan. 31, 2006, now U.S. Pat. No. 7,454,858, which is a U.S. national filing of international Patent application Serial No. PCT/US04/03760 filed Feb. 10, 2004 which claims priority under 35 U.S.C. §363, of international application Serial No. PCT/US03/35601, having an international filing date of Nov. 6, 2003, and which further claims priority under 35 U.S.C. §119(e) (1), of provisional application Ser. No. 60/492,509, having a filing date of Aug. 5, 2003, each of the referenced filings incorporated by reference in their entirety.

TECHNICAL FIELD

The present invention generally relates to a weapon grip assembly, more particularly, to a weapon grip assembly for forwardly supporting a weapon or weapon system.

BACKGROUND OF THE INVENTION

Weapons having barrels for discharging munitions are primarily adapted to be griped in the vicinity of the trigger, more particularly via a "pistol grip." A wide variety of styles and configurations are know for pistol grips, key considerations being functionality, ergonomics, and aesthetics.

For "long" barreled weapons, rifles for instance, forward support of same is accomplished via hand placement upon the forend, e.g., a barrel handguard or the like (i.e., a lower portion of the forward portion of the weapon). With the advent and advancement of weapon systems, for instance tactical weapons, the functionality of the "weapon" has become quite diverse, a challenge being to maintain an ease of use of the variety of features thereof, and avoidance of a cumbersome, inflexible and heavy weapon system.

Many members of the armed services and law enforcement officers, are issued, and carry a tactical weapon system which includes a "host weapon" (e.g., a rifle) which is equipped with, or may be equipped with, a variety of "supplemental devices," for instance a 40 mm grenade launcher. Such host weapons, sometimes referred to as modular weapon systems, are further configurable or adaptable to receive a variety of rails, interbars, or rail systems, upper/lower receiver and/or handguard components, buttstocks, or other accessories (e.g., sites, illumination devices, sling attachments or anchors, etc.). Traditionally, weapon system accessories have been manufacturer specific, each manufacturer of modular weapon systems providing items for integration with their rail, rail system etc. Although forward pistol grips are known and commercially available for integration with a forend assembly of a weapon, more particularly a rail or rail system, the variety of forend configurations available for a weapon have precluded a more versatile, "one size fits all" solution for forwardly supporting a weapon system in its variety of configurations.

For instance, in a weapon system comprising a host weapon (e.g., rifle) and a supplemental device (e.g., grenade launcher), the launcher mounts to the rifle in a position which places the launcher in the front half of the rifle, and below the rifle barrel. This location has been the standard of armed forces worldwide since the introduction of the rifle mounted grenade launcher about 40 years ago.

While the above described attachment method of the launcher to the host rifle may be the most practical solution for the integration of these separate devices, it does not provide the user with the best solution for carrying or operating the rifle or the launcher when the two devices are combined.

Carrying or operating the rifle/launcher combined weapon system requires that one of the operator's hands be placed on the pistol grip of the rifle, near the rifle trigger, while the other hand is placed near the forward end of the weapon system, beneath the grenade launcher, to support the system in a position chosen by the operator for carrying and/or operation of either device. The right hand, typically used to support the rear end of the rifle at the pistol grip, and to operate the rifle trigger, is partially wrapped around the pistol grip which allows the operator to close their fingers around same, and use their index finger to fire the rifle. The left hand, typically used to support the forward end of the rifle (i.e., the end away from the user) is placed below the grenade launcher, in a palm-up cup or cradle position, with the fingers and thumb wrapped partially around the launcher handguard to both support the weight of the rifle/launcher combination and control its orientation in all axes.

The palm-up position required of the operator's left hand is necessary because of the ribbed handguard of the 40 mm launcher barrel cannot be gripped by the operator's hand in any other way. Because the barrel is located below the launcher receiver, the handguard does not and cannot fully encircle the barrel, making it thereby impossible for the operator to wrap their hand around the barrel to establish a strong grasp on the barrel. This results in weak control of the weapon system and increased operator fatigue due to the necessitated hand position and orientation with respect to the weapon system, more particularly, the launcher thereof.

The diameter along the launcher handguard is over 2.25 inches, which is more than 50% larger than the optimal grip diameter for an operator with average sized hands to grip an object by wrapping their fingers around it, and having at least one finger wrap back to their thumb. The launcher barrel handguard is not sized to provide the best gripping surface, it is sized to accommodate the 40 mm barrel within it.

With the knowledge that this rifle/launcher combination is now front-heavy because of the shift in the rifle's center of gravity with the addition of the launcher, and that the handguard's diameter and orientation are controlled by the functional characteristics of the launcher, both a user and non-user understands why this weapon system combination, while highly desirable for its capabilities, is hard to control and is fatiguing to carry and operate, primarily because of the hand position and orientation required. The only solution to relieving the fatigue and adding additional control over the system for the operator is to change the way in which the operator holds the launcher.

There are many obstacles to developing a better way to grip the launcher. To provide maximum comfort, leverage and efficiency to the operator, the area in which the launcher is handled should not be changed, only the operator's hand position. The only way to change the hand position as required to grip the launcher is to add a gripping device. Adding any component, assembly or device to a 40 mm grenade launcher barrel presents a variety of challenges, some of which are discussed herein below.

First, the M203 40 mm barrel handguard is made of a thin plastic material which is designed primarily to serve as a location for the operator to place their hand. As there is very little heat produced when firing through an M203 barrel, the handguard is not specifically required to perform an insulating function.

Second, the M203 40 mm handguard surface is interrupted by two cartridge retainer rivets and a handguard locator rivet.

Such structures may interfere with attachment solutions, and therefore require consideration.

Third, the M203 40 mm barrel is a thin wall design which precludes using fasteners which only partially penetrate the barrel wall. As a matter of fact, the barrel handguard is adhesively adhered to the barrel because the barrel walls prohibit the use of fasteners. Furthermore, weapon barrels are generally not pierced by fasteners because of their prime function to contain exploding gases. Any solution requiring a fastener which breaches the barrel wall is not possible. Further still, the thin wall of the barrel prevents any attachment solution which could distort the barrel by applying pressure unevenly, such a barrel being incapable of proper performance.

Fourth, the barrel assembly of the M203 is designed for removal from the receiver without tools. This allows for easy cleaning by the operator as the barrel is the component most dirtied by firing. Being able to clean the barrel as a separate component keeps the rest of the receiver, and the rifle to which it is attached, uncontaminated by the cleaning process. Any grip attachment solution which prevents or inhibits this barrel removal process is undesirable. Furthermore, cleaning the barrel can be a messy affair using solvents to remove barrel reside and then repeatedly rinsing the barrel to remove the solvent residue. The barrel and handguard get contaminated on the outside during the process and must also be cleaned. A dry handguard is essential for the operator to maintain a grip. Any grip attachment solution that remains on the barrel during the cleaning process becomes another area to clean and is therefore undesirable.

Fifth, the barrel is also removable from the receiver to allow an armorer to perform repairs. Without removal it would be impossible to re-stake or change the barrel extension, repair or replace the cartridge locator or the cartridge locator spring. To perform these repairs the barrel is placed in a vise or other holder which positions and supports the barrel assembly along the sides and on the bottom during repairs. Any grip attachment solution that remains in place in any of these areas would inhibit maintenance activities and is likewise undesirable.

Finally, the handguard can be removed from the barrel for the repair of the cartridge retaining springs or for replacement of the handguard itself. Any grip attachment solution which is permanently affixed to the handguard would either inhibit or make this activity or exchange impossible.

Thus, it is highly desirable and advantageous to provide a weapon grip assembly for supporting a forend of a weapon or weapon system, more particularly a versatile weapon grip assembly for select integration with a 40 mm grenade launcher which:

- is commercially available "off-the-shelf" and requires no developmental effort;
- can be fitted to any M203 launcher now in service, with no modifications of same required;
- is small, lightweight and rugged;
- is not permanently mounted onto the launcher barrel assembly;
- can be quickly attached and detached from the launcher handguard by the operator without tools;
- conforms tightly to barrel surfaces;
- does not pierce the barrel or handguard;
- can be adjustably positioned on the launcher to suit operator size preferences and comfort;
- can aid and/or improve the firing accuracy of the weapon system (e.g., rifle and launcher) by allowing the operator to have improved control on the weapons because of a better grip;
- does not hamper or prolong maintenance activities of the launcher or rifle;
- does not implicate nor involve additional launcher or rifle operational considerations or limitations;
- requires no additional operator training for use thereof;
- improves operator weapon control, and thus, its safety;
- reduces operator fatigue by improving the method by which the launcher and rifle are operated and carried;
- allows the operator to easily focus all energy into motions associated with opening/closing the launcher barrel by reducing the effort required to grip the barrel while in motion;
- enhances the loading and re-loading operations of the M203, making them faster and more controllable, thereby allowing faster aimpoint acquisition by the operator for firing the next round;
- provides improved firing speed and accuracy which makes the operator safer and more effective;
- allows the operator to easily maintain or re-establish a firm grip on the launcher and rifle in humid, wet or snowy conditions or in the presence of any other contaminants which now make these actions difficult with the current hand position required to grip the launcher handguard; and,
- allows the operator to easily maintain or re-establish a firm grip on the launcher and rifle while using the weapons while walking, running or after a fall or other unexpected activity. This improvement in control makes the operator more effective and safer to others around them.

With weapon adaptability being an important consideration or factor for a weapon user, a "Rail Adaptor System" (RAS) has become a popular accessory for/on combat rifles and the like. There exists many versions of such systems, made by many manufacturers, see for example those produced by Knight's Armament Co.

Typically, a RAS is installed in place of the weapon hand guard (i.e., substituted therefore), and is intended to provide a universal structure (i.e., a rail) for mating attachment (i.e., receipt) of accessories, e.g., a flashlight, a thermal scope, a laser, etc., to the rifle at 3, 6, 9, and 12-O'clock positions about the weapon barrel. Known systems incorporate different rail lengths and integration techniques for attachment to the weapon. Some RAS consist of a two-piece assembly, namely, a first portion providing rails at the 3, 9, and 12-O'clock positions, a second portion providing a rail at/for the 6-O'clock position. It is advantageous that the rail of the 6-O'clock position be separately removable so as to permit grenade launcher installation (i.e., in lieu thereof, as each structure competes for the same physical space, and generally uses the same attachment points on the weapon).

The RAS system was originally proposed by the United States Army in 1998 so as to provide to all vendors a common style of attachment point to the M-16 rifle. While specifying the beveled lateral edge of the rail (i.e., its profile), the circumferential clock positions for the rails about the weapon barrel, and the call outs of the spacing between the crossbars of the rail and their marking (e.g., B22, B28, etc. for "bottom," with "T" designated for "top"), implementation of the solution (i.e., weapon integration strategies) was left to those in the marketplace.

In addition to the aforementioned accessories (i.e., flashlights, scopes, aiming aids, etc.), rail mount grips (e.g., vertical forend grips), are available for affixation to the rail, with heretofore know rail mount grips characterized by a female mounting flange which is slidingly received upon a rail of the RAS, and is thereafter selectively bound against a portion of the rail via, for example, a threaded fastener which is tightened to engage or press against the rail so as to secure the grip thereto.

In a rail mount grip offered by Knight's Armament Co., a binding stud is threadingly received within an axial bore of a hand grip having a rail receiving flange. The binding stud includes a base or cap end which defines a lower-most extremity for the device, and a free end opposite thereof having a nub (e.g., a centrally located projection) on a top surface thereof. Upon sliding the grip, via the flange, longitudinally along and upon the rail, the binding stud is upwardly extended, relative to the grip, such that the nub on the top surface of the free end thereof locates one of the many slots or spaced apart channels in the rail (i.e., the knob is dimensioned to be received within any one of said slots or spaced apart channels). Thereafter, the binding stud is further tightened into pressing engagement with a portion of the rail.

The subject design has proved problematic, with the nub being susceptible to breakage and or deformation, and requiring further operator attention to appropriately position the grip upon the rail such that the nub will in fact fall into one of the many locating slots. Since the slot and the raised portions between the slots of the rail are the same width, the operator has a 50-50 chance of getting it right the first time. Miss the location, and the grip will not tighten up.

A further drawback of presently known rail mount grips is the requirement that they be slid on, more particularly, they be slid onto the rail of the RAS from the weapon front (i.e., the muzzle end) toward the weapon back (i.e. the butt stock end). Known grips cannot be slid onto the rear end of the rail because there is not enough clearance between the rail end and rifle receiver to allow access for alignment of the flange with the rail. This is a critical consideration should any other accessory be mounted on the rail forward of the grip. Should a user wish to remove the grip from the weapon, or move it to a different rail to improve handling, a lot of busy time is had configuring or reconfiguring the weapon. Thus, it remains advantageous to provide a weapon grip which is versatilely mountable to the rail of a RAS, further still, to provide a rail mount grip which has an easily operable secure fastening or affixation mechanism, namely one which abandons heretofore known sliding engagements and/or binding studs.

Further desirable and advantageous is a forend grip for a weapon or weapon system which is versatile in its securement methodology. For instance, and as alluded to herein, a weapon grip having an adaptability or convertibility for receipt by a variety of known weapon or weapon system structures is particularly desirable, more particularly, a weapon grip characterized by grasping jaws. For instance, a weapon grip having replaceable or substitutable jaws for grasping a grenade launcher barrel on the one hand, or a rail of a RAS on the other hand is especially advantageous.

More specific features and advantages obtained in view of those features will become apparent with reference to the drawing figures and DETAILED DESCRIPTION OF THE INVENTION.

SUMMARY OF THE INVENTION

A preferred weapon grip assembly of the subject invention attaches to a forward portion of a weapon, for instance, to a handguard, by at least partially encircling same (i.e., clasping a portion thereof) with two clamps (i.e., jaws) of a base assembly which is supported for operative engagement by a handle. The base assembly further includes a post (e.g., a threaded stud) having a clamp end adapted to retain each of the clamps for pivot motion with respect thereto. The post of the base assembly is received within a bore of the handle, a mandrel being interposed between the handle and the clamps of the base assembly. As the base assembly is drawn into the handle, by rotation of the handle about the post of the base assembly, the mandrel receives or seats the clamp end of the post, with an upper free surface thereof engaging the clamps for pivoted closure about a portion of the weapon in furtherance of securing the weapon grip assembly thereto.

The handle of the weapon grip assembly advantageously includes a stowage space accessible at a free end thereof. A cap is further provided for sealing the stowage space. The preferred weapon grip assembly further includes a latching mechanism for reversibly securing the mandrel to the handle such that the mandrel and the handle ride upwardly upon the post of the base assembly to actuate the clamps and "lock" them in position about the weapon. Preferably, but not necessarily, the weapon grip assembly further includes an alignment and retention mechanism for positioning and holding (i.e., orientingly uniting) the mandrel upon the base assembly, more particularly, the clamp end thereof.

The subject weapon grip advantageously may be supplied with alternate clamping elements so as to be alternately equipped, that is to say, the weapon grip may be quickly and easily converted for grasping a grenade launcher barrel, or a rail of a RAS. In the former case, each of the jaws are curved throughout their length to grasp a launcher barrel, each of the jaws further having a surface (i.e., a barrel engaging surface) for receiving a rib of a barrel handguard. In the latter case, each of the jaws include a profiled surface, more particularly a rail receiving surface for engaging a lateral edge of a rail of a RAS. The clamps are configured such that upon being pivotally draw towards one another, a rail receiving channel is formed within which a rail of the RAS is captured or capturable.

BRIEF DESCRIPTION OF THE DRAWINGS

Referring now to the drawings wherein like numerals are used to designate like parts of the invention throughout the figures.

DETAILED DESCRIPTION OF THE INVENTION

Figure 1:
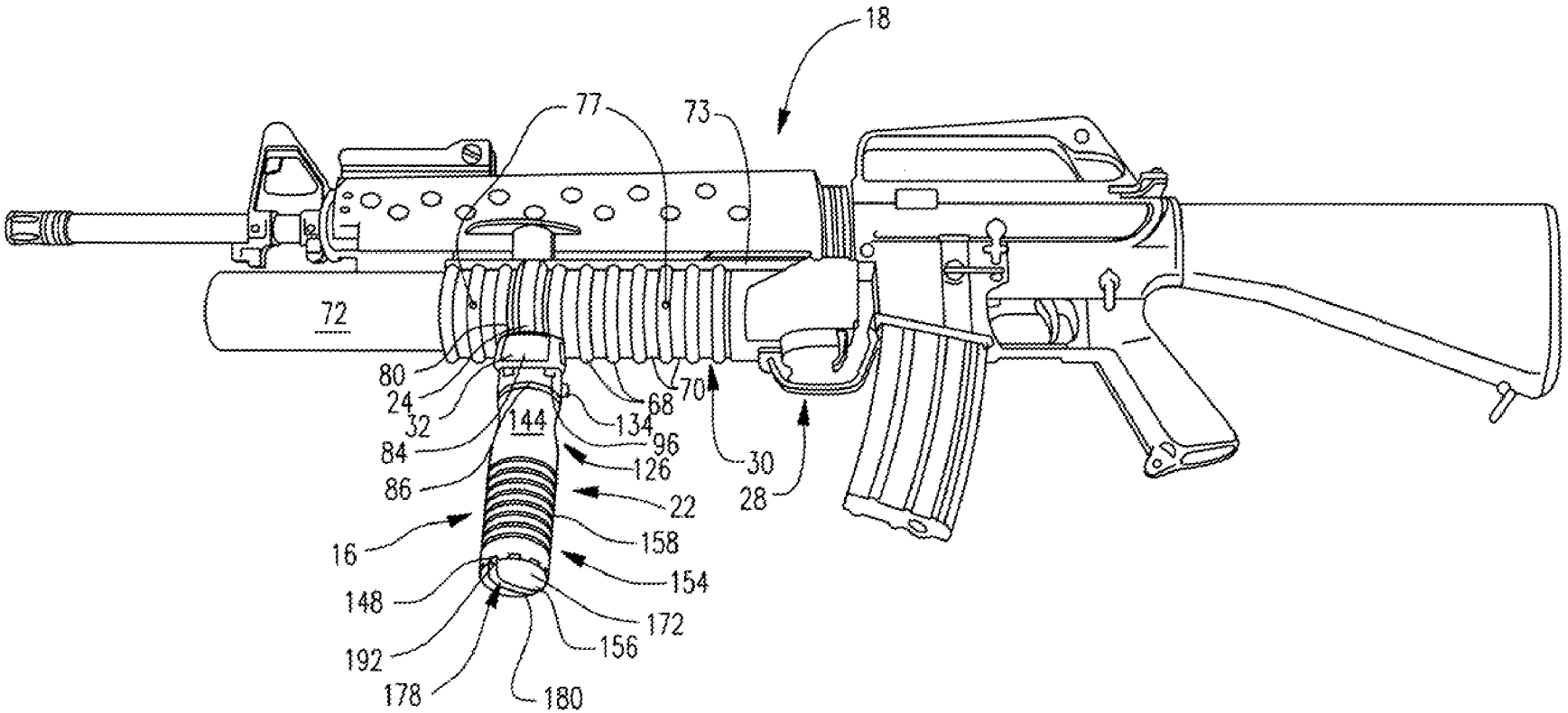
FIG. 1 illustrates the weapon grip assembly of the subject invention, in combination with a representative, non-limiting weapon, namely, an assault weapon.
Figure 15:
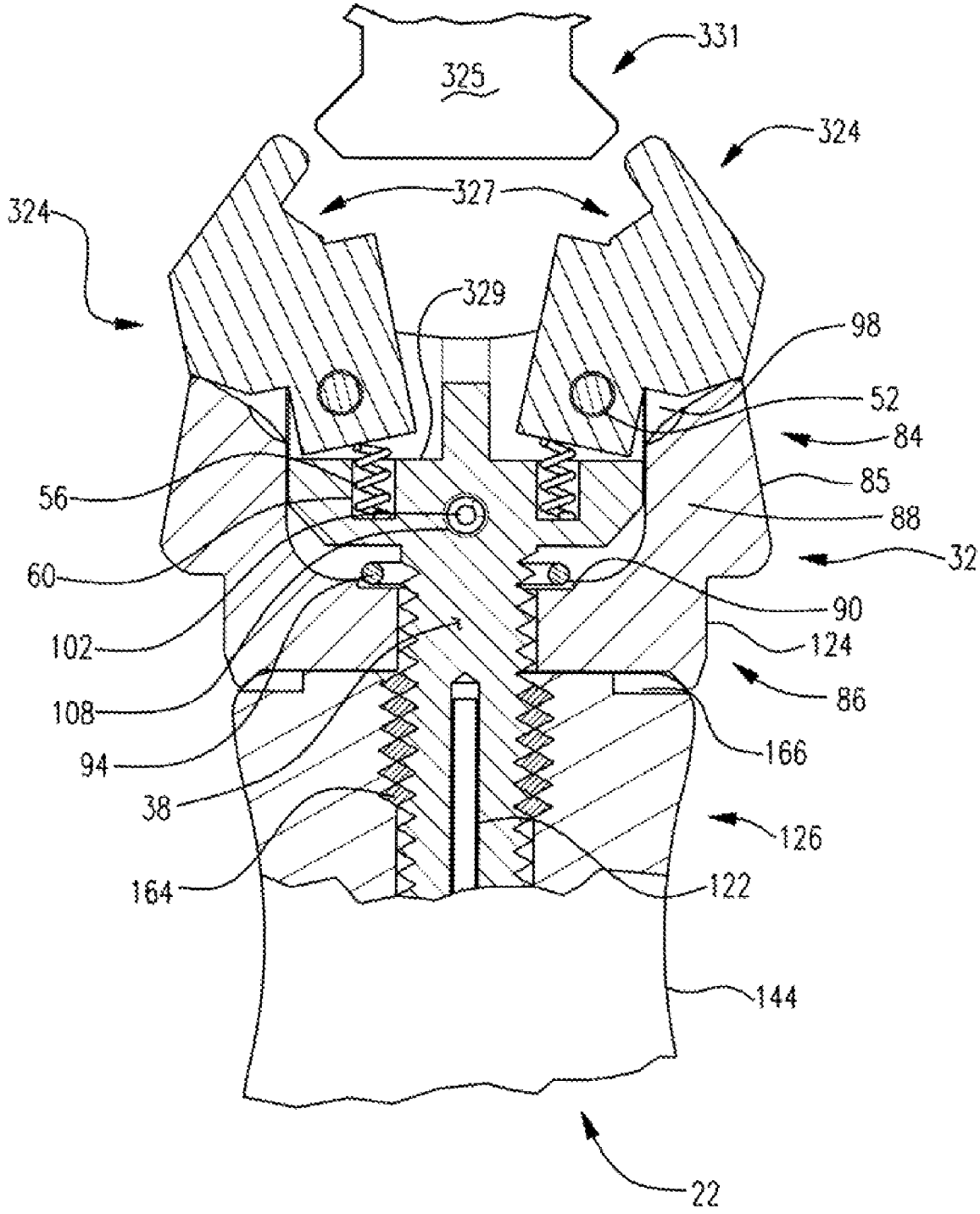
FIG. 15 illustrates a further embodiment of the subject invention, more particularly, a sectional view of an alternate clamp or jaw configuration in readiness for integration with a rail of a rail adaptor system; and, FIG. 16 is an exploded partial view, similar to that FIG. 4, illustrating the alternate jaws of the embodiment of FIG. 15 relative to the clamp end of the post.
Figure 16:
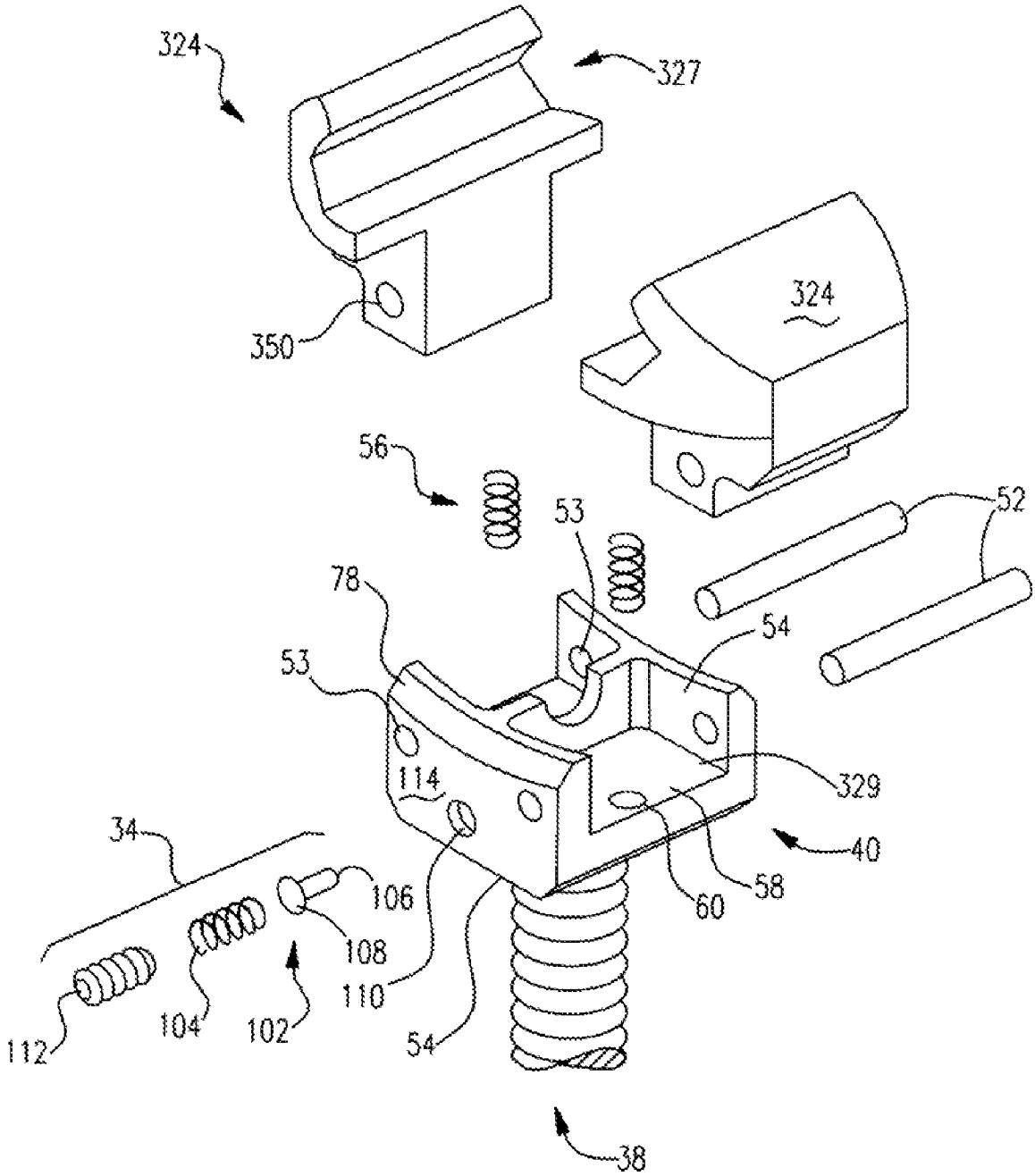

As a preliminary matter, the structures and features of the weapon grip or grip assembly of the subject invention, shown in FIG. 1 attached to a weapon system, are generally illustrated in the views of FIGS. 2-12. The functionality of the subject weapon grip assembly is best appreciated with reference to FIGS. 5-9, wherein there is specifically shown a variety of relationships between select structures and/or subassemblies of the subject invention and the weapon system, and among said select structures and/or subassemblies. Finally, further alternate, non-limiting embodiments of the subject weapon grip assembly are shown in FIGS. 13-16, more particularly, an embodiment emphasizing an alternate interface between the base assembly and the handle (FIG. 13); a further embodiment emphasizing an alternate handle latching mechanism (FIG. 14); and, still further, an embodiment emphasizing an alternate clamp or jaw configuration (FIGS. 15 & 16).

With reference to FIG. 1, there is generally illustrated a preferred embodiment of the weapon grip assembly 16 of the subject invention in operative engagement with a representative weapon, namely an assault weapon 18 (i.e., a weapon system). Generally, the weapon grip assembly 16 of the subject invention includes a base assembly 20 extending from, or supported by, a handle 22. The base assembly 20 includes clamps or jaws 24 adapted to be secured to a forward portion of the weapon 18 (e.g., a handguard of the forward portion thereof), more particularly, each of the clamps 24 preferably includes a weapon receiving surface 26. Operatively, the grasping function of the clamps 24 of the base assembly 20 is implicated via manipulation of the handle 22 relative thereto, more particularly, the interplay between structures of the handle 22 and base assembly 20 permit the clamps 24 to be reversibly secured to the forward portion of the weapon 18, as will be later discussed in greater detail, particularly with respect to FIGS. 5-9.

The weapon grip assembly 16 of FIG. 1 is representatively shown operatively depending from a grenade launcher 28, e.g., a M203 style 40 mm launcher. The weapon grip assembly 16 is selectively positionable for attachment to a ribbed barrel handguard 30 of the launcher 28 so as to depend therefrom. It should be understood and readily appreciated, especially in light of the subject disclosure, that the subject weapon grip assembly is not intended to be limited to attachment to a grenade launcher. It is emphatically noted that the clamps of the subject weapon grip assembly are generally intended to clasp a forward portion of the weapon or weapon system, the clasping function of the base assembly being particularly advantageous in the context of the subject weapon grip assembly.

Advantageously, the subject weapon grip assembly is designed for affixation to a forward portion of a weapon, such as a handguard, for forwardly supporting same. It is especially desirable to provide a weapon grip assembly which, with little or no modification, can facilitate forward support a weapon such as a rifle, as well as such weapon equipped with a supplemental device (e.g., grenade launcher), as are widely used by law enforcement and military personnel.

Figure 2:
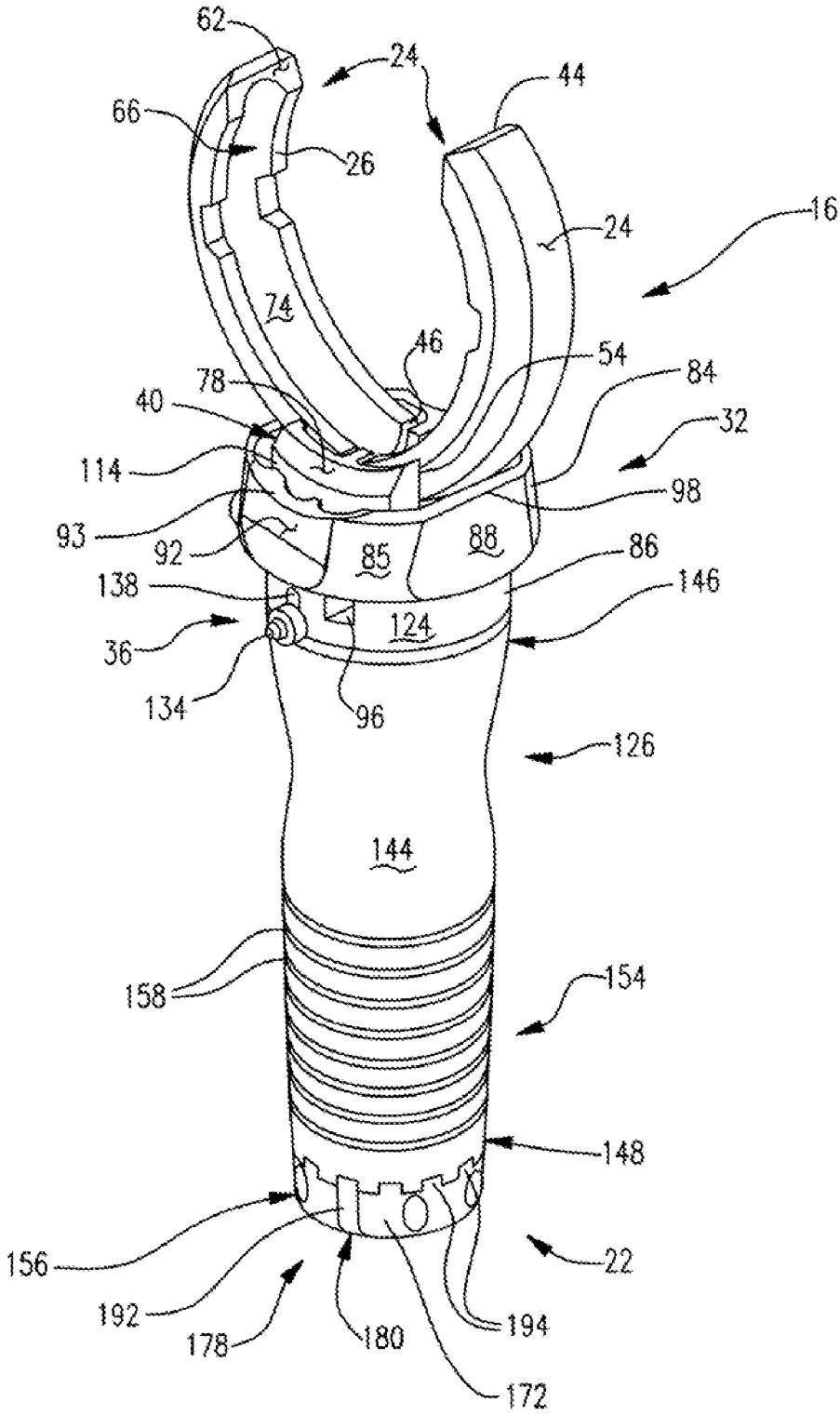
FIG. 2 is a perspective "forward" view of a preferred embodiment of the weapon grip assembly of the subject invention.
Figure 3:
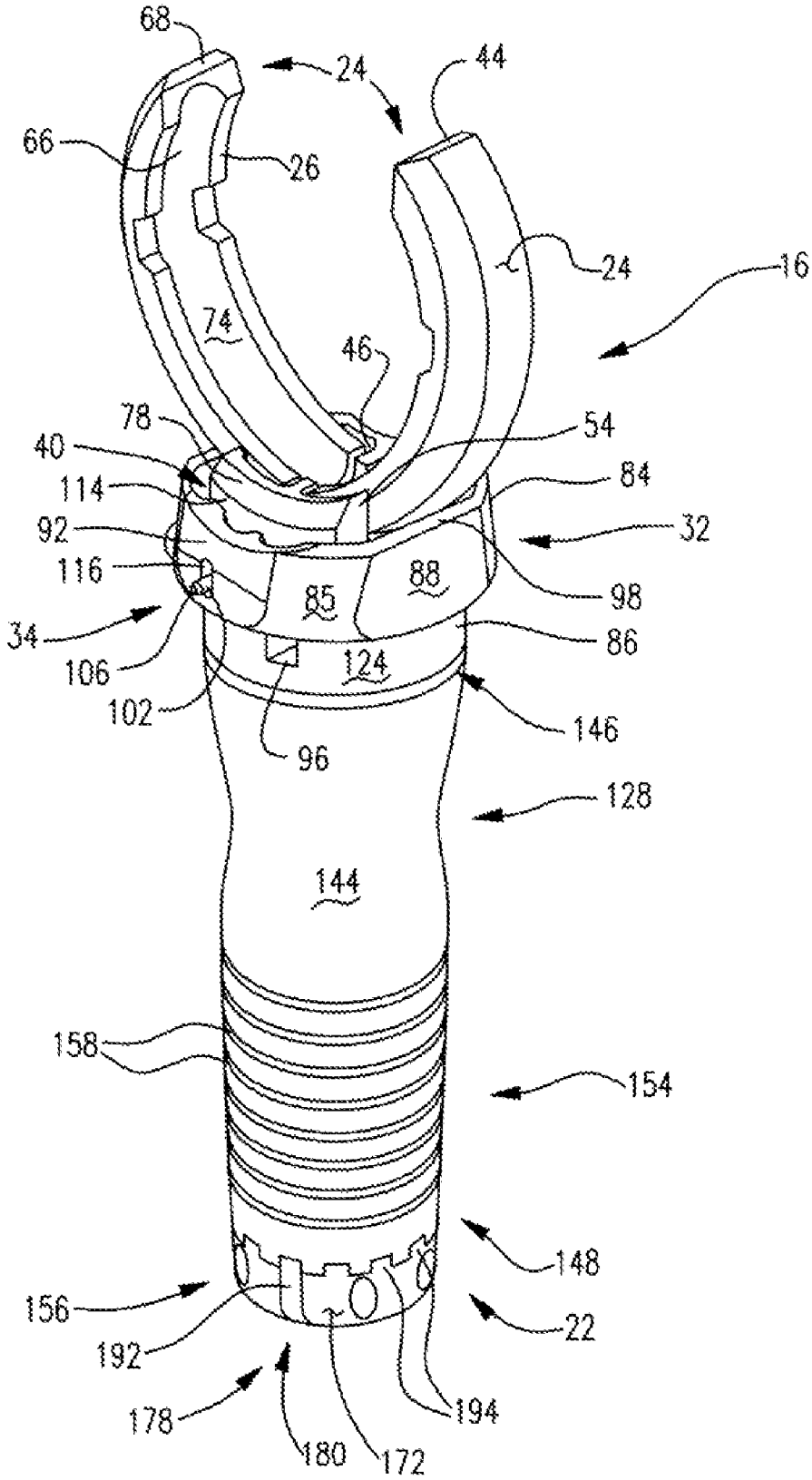
FIG. 3 is a perspective "rear" view of the weapon grip assembly of FIG. 2.
Figure 4:
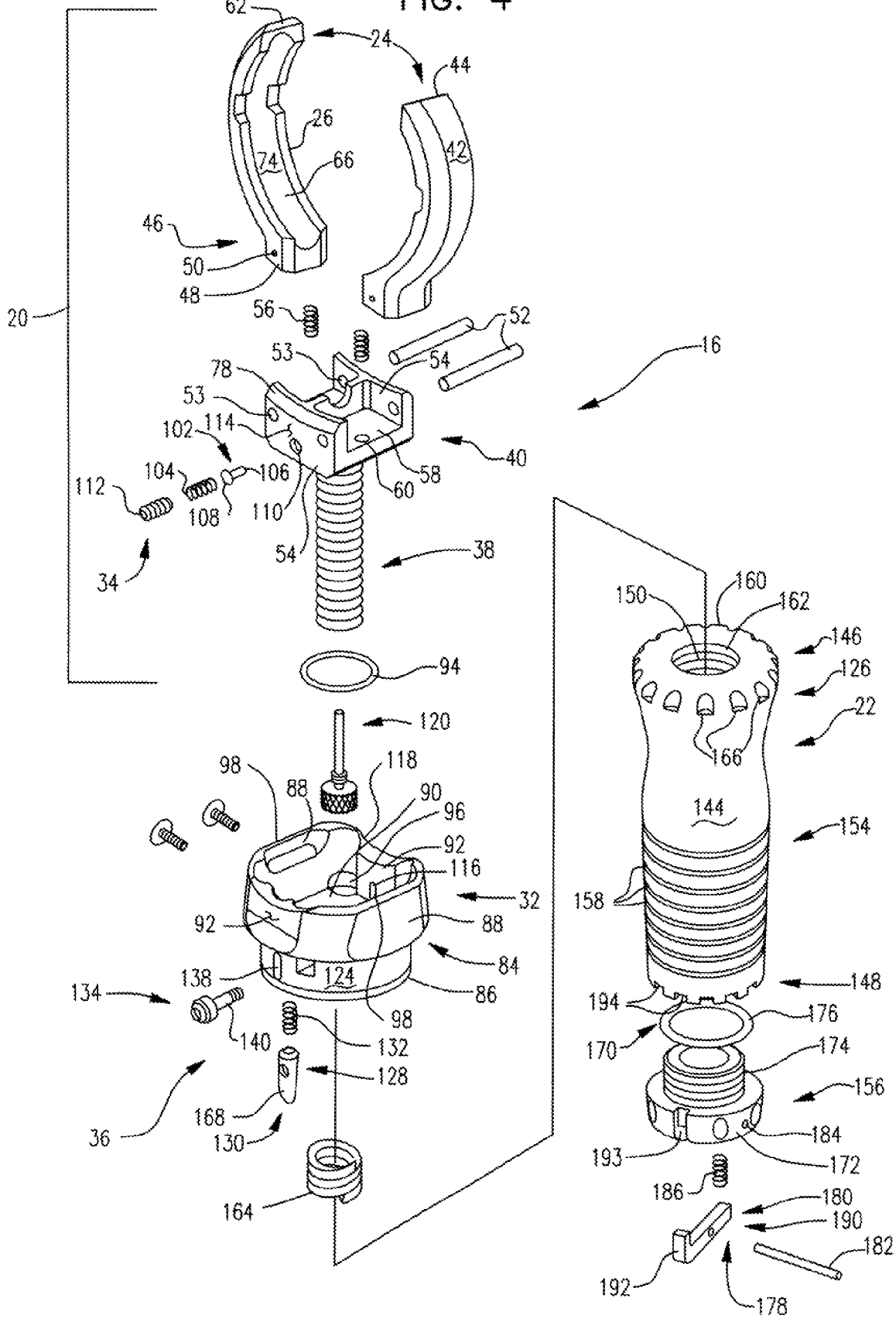
FIG. 4 is an exploded view of the weapon grip assembly of FIG. 2.

With general reference now to FIGS. 2 & 3, and particularly reference to FIG. 4, the preferred embodiment of the weapon grip assembly 16 of the subject invention generally includes a base assembly 20 extending from, or being generally supported by a handle 22, and a mandrel or collar 32 interposed between a portion of the base assembly 20 and the handle 22. Preferably, but not necessarily (note the devices of FIGS. 13 & 14), the weapon grip assembly 16 further includes an alignment and retention mechanism 34 (i.e., a retainer), for positioning and holding (i.e., orientingly uniting) the mandrel 32 upon the base assembly 20, and still further, preferably, but not necessarily, includes a latching mechanism 36 for reversibly securing the handle 22 to mandrel 32, thereby fixing subject spatial relationship(s) between the handle 22 and the base assembly 20 as will be later discussed.

The base assembly 20 of the weapon grip assembly 16 includes clamps or jaws 24 adapted to be secured to the forward portion of the weapon, and a post 38 having a clamp end 40 adapted to retain the clamps 24 (FIG. 4). The clamps 24 are retained or anchored to the clamp end 40 of the post 38 for pivot motion with respect thereto, and are further preferably individually biased so as to readily accept the forward portion of the weapon system (i.e., the weapon grip assembly is intended to have a readied condition for affixation to the weapon, namely a pre-application/pre-affixation status or "static" condition). The base assembly components, namely the clamps 24 and post 38, are preferably fabricated from aluminum, and are hard-coat anodized in black.

Each of the clamps 24 of the base assembly 20 generally has a weapon receiving surface 26 opposite an exterior or outer surface 42, and opposing ends, namely a free end 44 opposite a base end 46. As is best seen in FIG. 4, the base end 46 of each of the clamps 24 is preferably adapted for pivot motion (e.g., hinged engagement) upon the clamp end 40 of the post 38 (i.e., the distance between the free ends 44 of the clamps 24 is not fixed, that is to say, there exists a range of travel between the free ends 44 of the clamps 24). The base end 46 of each of the clamps 24 preferably has a lobe-like configuration, i.e., a surplusage of material on the exterior surface of the clamp: the base end 46 has a local exterior surface which extends or protrudes beyond a contour of an outer radius of the clamp 24, (more particularly, a contour or profile associated with the exterior surface 42 thereof), see FIGS. 4 and 5/6.

Each lobe 48 (i.e., locally thick segment or terminus) of the base end 46 of the clamp 24 includes a thru hole 50 for receipt of a pin 52 which traverses opposing upstanding wall segments 54 of the clamp end 40 of the post 38 via a set of paired and aligned thru holes 53, thereby securing the clamp 24 to the post 38. The pins 52, and pin holes 50, 53, are of a specific design so as to allow the pins 52 to be inserted from one side of the clamp end 40 of the post 38 yet be held in secure, fixed position by an interference fit on the other side thereof. This assembly method permits field replacement of a clamp which may become damaged, while avoiding screw-type fasteners which can become loosened. The pins are a strong steel material coated for corrosion protection.

The clamp pin 52 defines a pivot axis for each of the clamps 24, the range of pivot motion for the clamps 24 being regulated by the mandrel 32, that is to say, the interrelationships and interactions of and between the components of the weapon grip assembly of the subject invention, e.g., the handle 22/base assembly 20, in response to the geometry and configuration of the weapon system to be clasped. The lobe configuration for the base end 46 of the clamp 24, essentially the excess material in the vicinity of the pivot axis thereof, ensures structural integrity in the vicinity of the clamps thru hole 50, for of long term reliable pivoting thereof.

Figure 5:
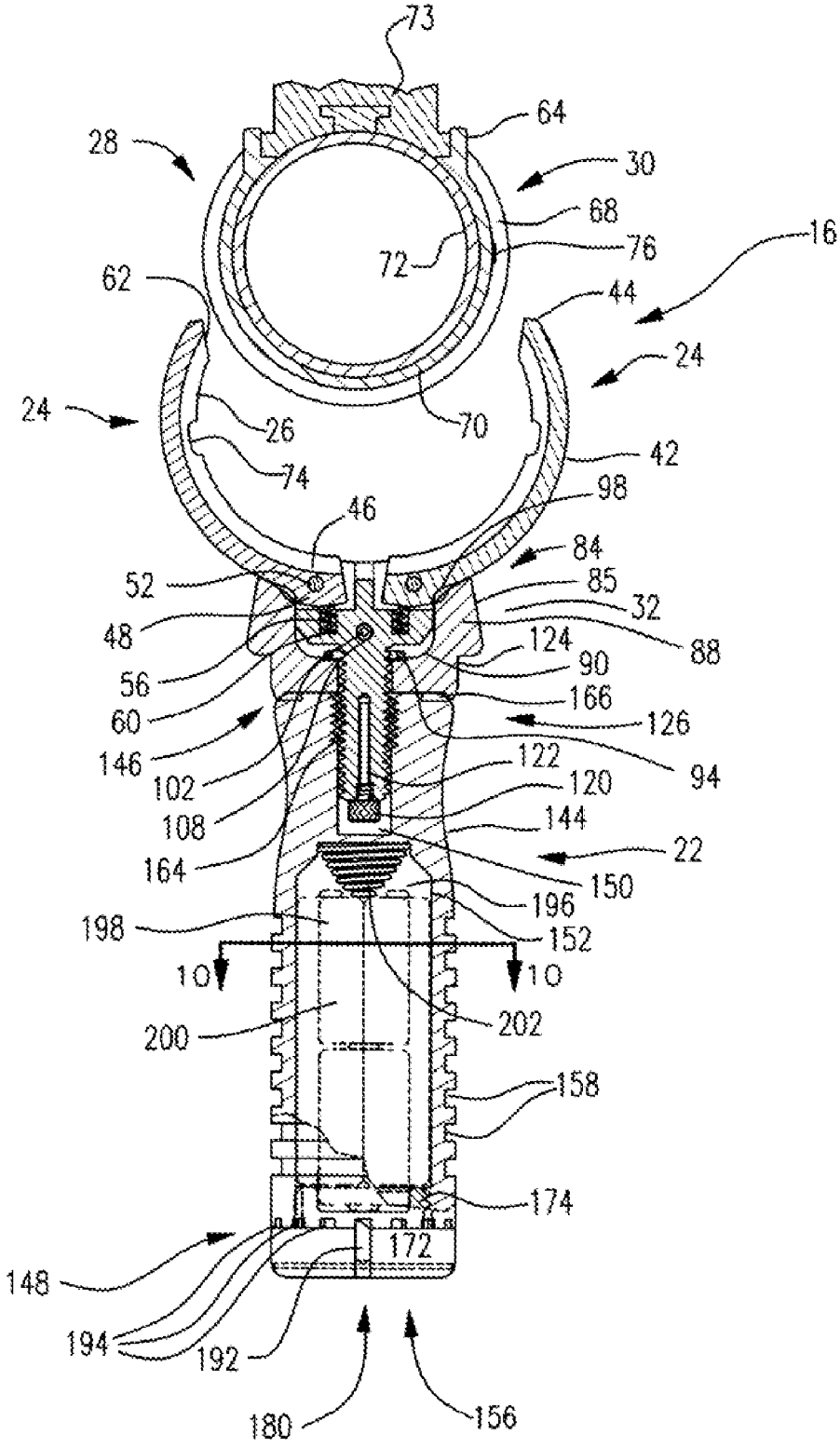
FIG. 5 is a "front" elevational cross section of the weapon grip assembly of FIG. 2, illustrating the clamps thereof in a readied condition for receipt of a forward portion of a weapon, more particularly an M203 style grenade launcher.

As previously noted, in furtherance of readily receiving and grasping a portion of a weapon system, a static condition for the weapon grip assembly 16 advantageously positions (e.g., biases) the jaws 24 of the base assembly 20 in an "open" condition (FIG. 5). A compression spring 56, one for each of the clamps 24, is seated so as to be interposed between an exterior surface of the lobe 48 of the base end 46 thereof, and a surface 58 from which the opposing upstanding wall segments 54 of the clamp end 40 of the post 38 extend (i.e., a "floor" of the clamp receiving "space," see FIGS. 4 and 5/6). In the static condition for the weapon grip assembly 16 (FIG. 5), the springs 56 bias each of the clamps 24 (i.e., impart a force upon the base end 46 of the clamp 24) such that the clamps 24 are "open," in readiness for capturing a portion of the weapon. The biasing effect of the springs 56 upon the clamps 24 is negated, or more generally regulated, to the point where the springs 56 are compressed and the free ends 44 of the clamps 24 secured to the weapon 18 (FIG. 6), by the mandrel 32 as will be later discussed.

A further advantageous feature of the subject invention is that the clamps 24 cannot open far enough to allow the opening springs 56 to come loose and fall out. This is because of the special relationship between the locations of the clamps end pin holes 53, the clamp pin holes 50, spring holes 60, the length of the springs 56, and the height of the side walls 54 of the clamp end 40 of post 38. A further functionality of the springs 56 is to eliminate any rattle that might otherwise be caused by an operator carrying the weapon grip assembly 16 without the clamps 24 being manually moved to their fully closed position. As should be readily appreciated, any excess noise at critical times can endanger the operator.

Figure 6:
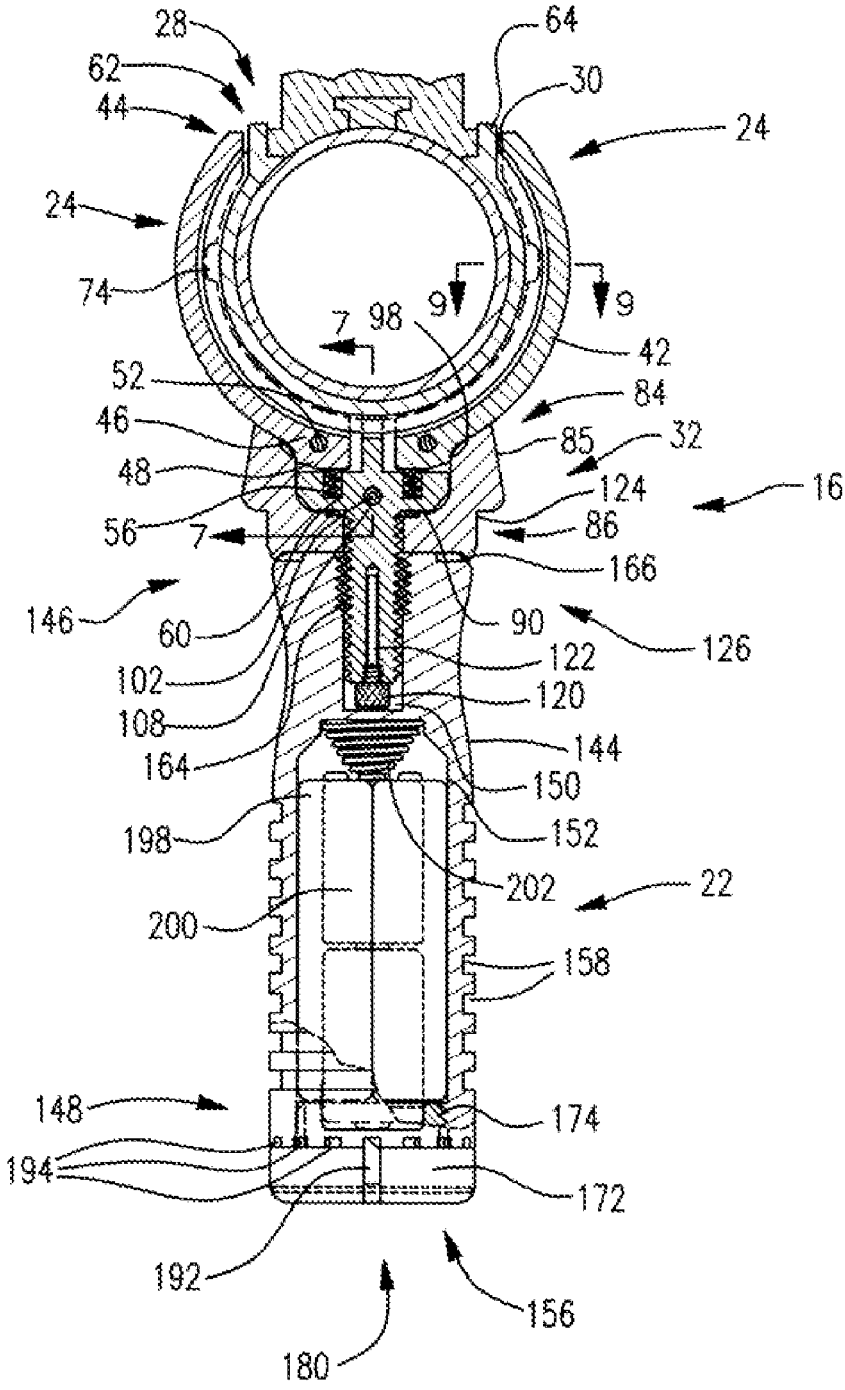
FIG. 6 is a view as FIG. 5, the clamps of the subject invention shown pivoted from their static FIG. 5 position, and in secure engagement with the handguard of the grenade launcher.

The free ends 44 of each of the clamps 24 preferably, but not necessarily, have a profiled tip 62, that is to say, the tip 62 of the free end 44 is not square or squared. Rather than having a single planar surface joining or uniting the exterior 42 and weapon receiving 26 surfaces, a combination of planar surfaces, extending from the exterior 42 and weapon receiving 26 surfaces of the free end 44, unite, at about a 90° angle, to define the free end terminus or tip 62. The subject clamp tip configuration is advantageous in that it permits mating of each of the clamps 24 with the upper portion of the handguard 30, e.g., a vertical lip 64 thereof, such that motion circumferentially about the launcher handguard 30 is prohibited, yet the relationship between the clamp tip 62 and the handguard 30 permits a calculated amount of play to accommodate inherent manufacturing tolerances of the handguard, as well as those between the variants of known manufacturers tolerances of the grip, as well as debris infiltrations (FIG. 6).

Each of the clamps 24 of the base assembly 20, in furtherance of clamping, is preferably curved throughout a length thereof, that is to say between the base 46 and the free end 44 of same. The weapon receiving surface 26 of each of the clamps 24 is adapted to cooperatively engage (e.g., receive or seat) an exterior surface of the handguard 30 of the forward portion of the weapon (see FIG. 9). For instance, in the context of receipt upon the grenade launcher 28 of FIG. 1, the weapon receiving surface 26 includes a concave segment 66, more particularly a radiused groove, for receipt or seating of a rib 68 of the barrel handguard 30.

Although the "flats" 70 of the handguard 30 might intuitively be preferable for receipt of a grip or handle, the ribs 68 thereof provide integral indexing and 90° alignment with a longitudinal axis of the launcher barrel 72. The radiused groove 66 of the weapon receiving surface 26, among other things: facilitates operator selection a specific rib location on the handguard for handle placement vis-a-vis the weapon grip assembly; maintains the select position; and, helps the weapon grip assembly in its entirety, especially the handle thereof, to resist fore and aft motion (i.e., longitudinal movement) when the operator is pulling/pushing on it while operating or carrying the weapon system.

Each of the clamps 24 further includes a radiused recess 74 across a short axis thereof, above a length mid-point for same (i.e., positioned closer to the free end 44 of the clamp 24 rather than the base end 46 thereof). The radiused recess 74 effectively traverses (i.e., laterally traverses) the weapon receiving surface 26 from one lateral side edge to another lateral side edge. Depending on the handguard producer, a rivet 76 of (FIG. 5) a locater disk, not shown, can protrude significantly from the launcher barrel 72. The radiused recess 74 of the weapon receiving surface 26 allows the clamps 24 of the base assembly 20 to be positioned on top of, or over, the rivet 76 without consideration for its protrusion (i.e., permits unencumbered attachment thereover, FIG. 6), so as not to limit positioning options relative to the launcher.

As previously noted, the base assembly 20 also includes post or stud 38 which, among other things, supports the clamps of the base assembly 20. At least a portion of the post 38 is threaded for integration with the handle 22, as evidenced by reference to FIG. 4, more particularly, the threaded portion of the post 38, and thus entire base assembly 20, is intended to be drawn towards or into the handle 22.

An extremely close fit of the clamps 24 and the clamp end 40 of the post 38 to the handguard 30 is especially advantageous for proper functioning of the subject device. The more perfect the fit, the less pressure will be needed to hold the grip assembly in proper position. In furtherance thereof, the upstanding wall segments 54 of the clamp end 40 of the post 38 (i.e., the walls between which the clamps 24 are interposed for pivoted support, FIG. 4) include a profiled (e.g., beveled) upper edge 78 (i.e. r barrel rib contact surface, see FIG. 7). The upper edge 78, more particularly, the outer upper edge, of each upstanding wall segment 54 is adapted to abut a portion of a rib 80 adjacent the rib 81 seized by the clamp or jaw 24. The aforementioned structural feature prevents forward and backward release of the weapon grip assembly 16, yet safely allows a small amount of rocking at high push/pull pressures.

The mandrel or collar 32 of the weapon grip assembly 16 of the subject invention is positioned to operatively unite the handle 22 with the base assembly 20, namely, engage or receive the clamp end 40 of the post 38 and the clamps 24 themselves. In furtherance thereof, the mandrel 32 preferably has upper 84 and lower 86 portions, the lower portion 86 being received or seated upon the top of the handle 22, the upper portion 84 receiving or seating the clamp end 40 of the post 38, and engaging the clamps 24. The mandrel 32 is generally received upon the post 38 of the base assembly 20, see e.g., FIGS. 4 & 5, so as to "ride" the handle 22 "up" the post 38 of the base assembly 20 as will be later detailed with reference to FIGS. 5 & 6. The mandrel 32 is preferably fabricated from aluminum, and is hard-coat anodized in black.

Structurally, the upper portion 84 of the mandrel 32 includes at least one set of opposingly paired walls 88, primary walls for the sake of the discussion, between which extends a "floor" 90 (i.e., the walls 88 upwardly extend from the floor 90). Preferably, but not necessarily (see FIGS. 13 & 14), the upper portion 84 of the mandrel 32 includes a further set of opposingly paired walls, namely, secondary walls 92. The floor 90, which includes a thru hole or aperture for receipt of the post 38 of the base assembly 20, in combination with the upstanding walls 88, 92, effectively "house" the clamp end 40 of the of the post 38, and thereby protect the pivot linkage of the clamps 24 with the post 38 (compare FIG. 2 or 3 with FIG. 4). A sealed interface between the mandrel 32 and the post 38 of the base assembly 20 is advantageous, and achieved via the imposition of a o-ring 94, which is received about the post 38 adjacent the clamp end 40, between the clamp end 40 of the post 38 and the floor 90 of the upper portion 84 of the mandrel 32. This seal helps assure that fluids or other contaminants do not enter or migrate into the handle 22. The seal also smooths the final 30° of tightening motion (i.e., rotation) of the handle by the operator, and makes releasing the grip from the handguard easier. Finally, in furtherance of maintaining a debris free environment, the upper portion 84 of the mandrel 32 preferably includes apertures 96 to facilitate egress of debris which might otherwise collect within the upper portion 84 thereof.

Each of the primary walls 88 of the upper portion 84 of the mandrel 32 preferably include a profiled (e.g., beveled) top edge 98 which defines a point of contact (i.e., a contact line or surface) for and/or between the mandrel 32, namely the upper portion 84 thereof, and each of the clamps 24. As may be readily appreciated based upon the disclosure to this point, the clamps 24 of the base assembly 20 pivotingly respond to axial positioning of the mandrel 32 relative to the post 38 of the base assembly 20.

Figure 7:
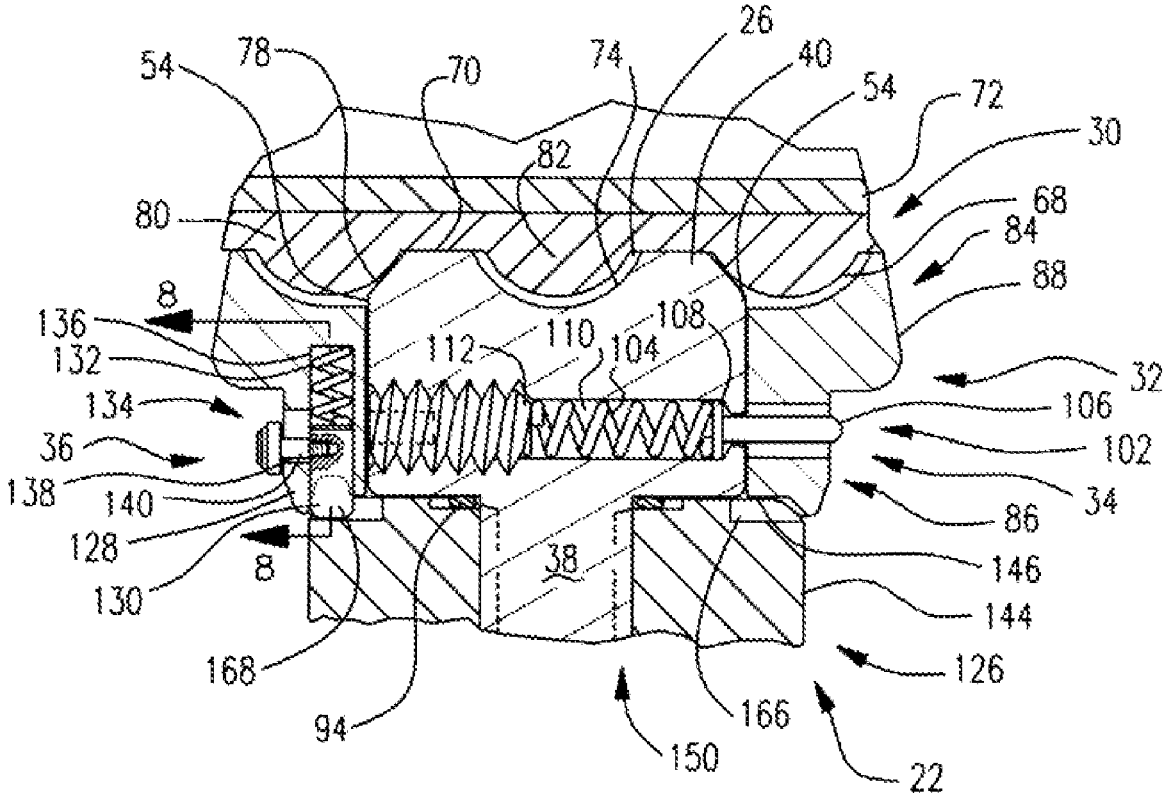
FIG. 7 is a section taken along lines 7-7 of FIG. 6 illustrating a locking mechanism for the handle, in addition to an alignment and retention mechanism for the mandrel.

With particular and further reference now to FIG. 7, the alignment and retention mechanism 34 of the subject invention ensures proper positioning of the mandrel 32 on the post 38 while limiting vertical or axial travel with respect thereto, such that the primary walls 88 of the upper portion 84 of the mandrel 32 are at all times positioned to underlay and ultimately engage the clamps 24 of the base assembly 20. The alignment and retention mechanism 34 generally includes a detent assembly 100, namely a detent pin 102 and compression spring 104, carried by the post 38, more particularly the clamp end 40 of the post 38.

The detent pin 102, which preferably has a radiused free end 106, is maintained in an extended position by the force of the compression spring 104. The detent pin 102 is held captive by a wide round base 103, upon which the spring 104 acts, which cannot fit through a hole 100 from which the radiused free end 106 of the detent pin 102 extends or protrudes. The compression spring 104 is retained within the clamp end 40 of the post 38 by a threaded set screw 112, preferable further secured using thread locking compound as is well know.

The radiused free end 106 of the detent pin 102 of the alignment and retention mechanism 34 biasingly extends from the bore 110, beyond a lateral surface 114 of one of the opposing upstanding wall segments 54 of the clamp end 40 of the post 38. The upper portion 84 of the mandrel is adapted to lockingly receive the detent pin 102. In furtherance thereof, one of the secondary walls 92 of the upper portion 84 of the mandrel 32 includes an aperture or slot 116 therethrough for receipt of the detent pin 102, the travel of the mandrel 32 relative to the base assembly 20 being thereby limited to the geometry or configuration of the slot 116. An upper edge of the subject secondary wall 92 is delimited by a ramped surface 119 which, upon fitting the mandrel 32 upon the post 38, momentarily compresses the detent pin 102 for subsequent biased extension, and therefore positioning into a capture within the slot 16. An integral tool 120 is preferably, but not necessarily, provided as part of the base assembly 20 to actuate the detent pin 102 (i.e., compress the pin 102, i.e. the radiused free end 106 thereof, into the bore) in furtherance of removing the mandrel 32 from the base assembly 20. The detent pin tool 120 is adapted to be reversibly received within an axial bore 122 of the post 38 as shown.

The lower portion 86 of the mandrel 32, which includes a wall 124 downwardly extending from the upper portion 84 of the mandrel 32, essentially receives a top portion 126 of the handle 22. The wall 124 of the lower portion 86 of the mandrel 32, which is circumferentially configured to cooperatively engage (i.e., encircle) the top or upper portion 126 of the handle 22, depends from the upper portion 84 of the mandrel 32 such that the "underside" of the floor 90 of the upper portion 84 of the mandrel 32, in combination with the wall 124 of the lower portion 86 thereof, defines a space into which the top of the handle 126 is received.

Figure 8:
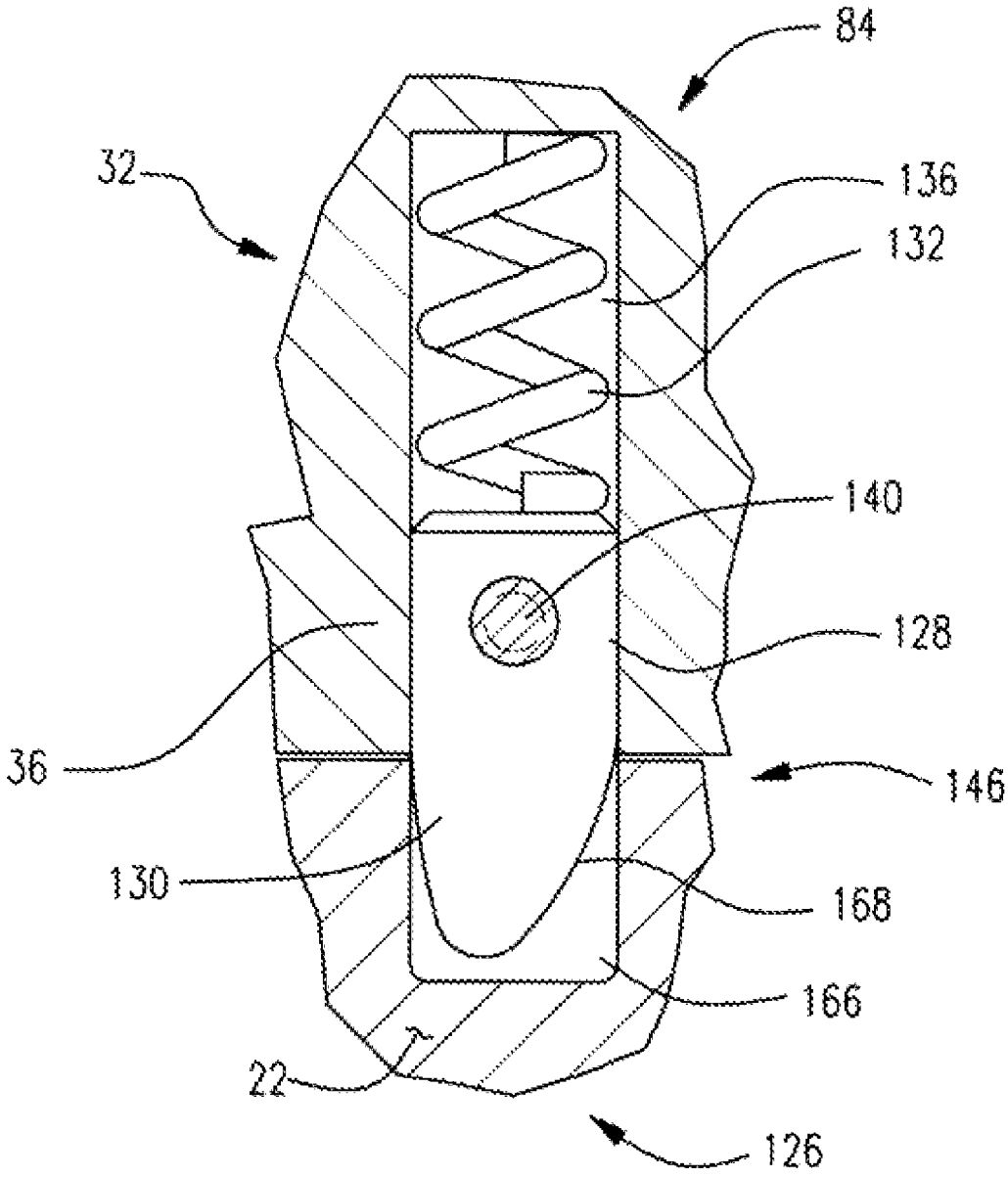
FIG. 8 is a section taken along lines 8-8 in FIG. 7 further illustrating the locking mechanism for the handle.

Integral with the mandrel 32 is the latching assembly 36 for reversibly securing the subject weapon grip assembly to a weapon system. The latching assembly or system 36 preferably, but not necessarily (see also FIGS. 13 & 14), includes a detent pin 128 having a chisel tip 130, a compression spring 132 for biasing the pin 128, and an actuator (e.g., stud 134) extending from the detent pin 128 (FIGS. 7 & 8). A vertical bore 136 of the mandrel 32 receives the spring 132 and detent pin 128 for biasing the pin 128, more particularly the chisel tip 130, toward the top of the handle 126 which is adapted to selectively (i.e., indexingly) receive same. The wall 124 of the lower portion 86 of the mandrel 32 includes an aperture or slot 138 through which extends a portion of the actuator (i.e., a shaft 140 of the stud 134 passes through the aperture 138 for threaded engagement within a threaded side bore of the detent pin 128). The aperture 138 (e.g., a vertically oriented oval or the like) permits vertical travel of the actuator 134, and therefore detent pin 128. As will be later detailed, the actuator 134 is positioned for easy thumb manipulation in furtherance of disengagement of the chisel tip 130 of detent pin 128 from the top portion 126 of the handle 22.

The handle or hand grip 22 of the subject weapon grip assembly is generally configured so as to comfortably "fit" a typical user's hand, even when using gloves. It is essential that the handle be readily grasped in a variety of environmental conditions. The handle is preferably fabricated from a copolymer acetal resin, more particularly, a copolymer acetal resin marketed by E. I. Du Pont De Nemours under the Delrin® mark, due to its superior physical and manufacturing characteristics.

As is readily appreciated with reference to FIGS. 4 and 5 or 6, the handle 22 generally has a round cross section, preferably, but not necessarily, a non-uniform circular cross section throughout a length thereof. An exterior surface 144 extends between opposing ends of the handle, namely, the free (i.e., top 146 and bottom 148) ends thereof, circumferentially extending longitudinally about a longitudinal axis of the handle. The handle 22 further preferably includes discrete upper 150 and lower 152 compartments, approximately corresponding to upper 126 and lower 154 handle portions. The upper compartment 156 (e.g., a bore) is accessible at the top end 146 of the handle 22 (FIG. 4), whereas the lower compartment 152 is accessible at the lower 154 end portion of the handle 22 which is preferably adapted to receive a cap, more particularly and advantageously, a reversibly locking cap 156.

The lower 154 portion of the handle 22 is preferably uniform in dimension throughout its length, and includes grooves in the exterior surface 144 thereof, more particularly, spaced apart circumferential grooves 158 as shown, e.g., FIG. 5. It should be noted that alternate surface adaptations in the lower handle portion 154, to facilitate sure comfortable hand gripping, are readily appreciated, well know, and contemplated in the context of the subject invention.

The upper portion 126 of the handle 22 is advantageously of non-uniform dimension throughout its length, more particularly, and with respect to the longitudinal axis of the handle 22 and the lower handle portion 154, a radius of the handle 22 initially upwardly decreases, then upwardly increases, terminating in a rounded top edge 160 for the handle 22 (FIG. 5). In addition to ergonomic considerations, the subject configuration, more particularly, that portion of the handle 22 received within the lower portion 86 of the mandrel 32 (see FIGS. 5-7), provides mechanical advantages in furtherance of attachment of the assembly to a weapon.

As previously noted, the top of the handle 126 is adapted to preferably receive a subassembly of the weapon grip assembly, namely, the mandrel 32 in combination with the base assembly 20. The upper compartment 150, (e.g., an axial or longitudinal bore) receives the post 38 of the base assembly 20 therein, more particularly, the threads of the post 38 are received for integration a threaded portion 162 of the bore 150, more particularly, a Helicoil® threaded metal insert 164, provided to assure a long term reliable interface between the base assembly 20 and the handle 22. The bore 150 is of a sufficient length to accommodate the operative travel length of the post 38 within the handle 22 (i.e., the post 38 may be drawn into the handle 22, for securing the clamps 24 about a portion of the weapon, without bottoming out).

The top edge 160 of the handle 22 includes spaced apart notches 166 for receipt of the chisel tip 130 of the detent pin 128 of the latching mechanism 36. Rotation of the handle 22 about the post 38, (i.e. within the bore 150 of the upper handle portion 126), implicates the latching mechanism 36: as the top perimeter edge 160 of the handle 22 contacts the detent pin 128 with "forward" rotation of the handle (i.e., tightening), a ramp surface 168 of the chisel tip 130 permits the detent pin 128 to easily move from one notch to another of the spaced apart notches 166 (i.e., ride over the surfaces delimiting the notches); manipulation of the actuator 134 of the latching mechanism 34 is required to overcome the bias force supplied to the detent pin 128, and thereby permit "reverse" rotation of the handle 22 (i.e., loosening) relative to the subassembly, and thus the weapon grip assembly (FIGS. 7 & 8).

The lower portion 154 of the handle 22 is adapted to receive a cover or cap 156 which is reversibly receivable at the free end 148 of the handle 22 (FIG. 4), more particularly a mouth 170 of the lower compartment 152 of the handle 22. The cap 156 generally includes a head 172 and stem 174 extending from a surface thereof, the stem 174 bearing threads or other means of integration with the handle 22 (FIGS. 4, 5/6). An o-ring 176 is advantageously received upon the threaded stem 174 of the cap 156 so as to sealing seat the head 172 of the cap 156 relative to the mouth 170 of the lower compartment 152 of the handle 22.

The head 172 of the cap 156 is preferably configured so as to generally conform with the configuration of the free end 148 of the handle 22 (FIG. 5 or 6), thereby providing a seamless or pseudo-seamless exterior finish for a base of the handle 22 (i.e., the interface of the free end 148 of the handle 22 with the cap 156 does not form an abrupt exterior contour, nor does the head 172 of the cap 156 include any protrusions). In furtherance thereof, the head 172 of the cap 156 is generally cylindrical, having a diameter substantially equivalent to that of the free end 148 of the handle 22.

Although not shown, the cap head 172 advantageously includes slots, grooves, dimples or other surface features (i.e., indentations). For instance, an exterior surface of the cap head 172 might include crossing slots which can be used by the operator to open (i.e., release) the cap via a 40 mm cartridge case, knife or coin if necessary, or may further or alternately include fluted edge portions (i.e., the union of the exterior surface with the sidewall of the cap head may form an irregular edge which is easily grasped) to aid the operator in gripping the cap for affixation/removal.

The head 172 of the cap 156 preferably, but not necessarily, includes a latching mechanism 178, functionally equivalent to the latching mechanism 36, previously discussed, which prevents unwanted loosening of the cap 156 from the handle 22 (FIGS. 4 & 5). Keeping the cap in place prevents it from being lost by unplanned removal caused by operator handling of the handle of the weapon grip assembly.

The cap latch mechanism 178, as best seen in FIG. 4, preferably includes a pawl 180 which rotates or pivots about a pin 182 which is received and retained within a transverse bore 184 of the head 172 of the cap 156. The pawl 180 is biased by a compression spring 186 located under a distal portion thereof, namely a free end 190, which is opposite a latch end 192 of the pawl. As will later be explained, the spring 186 holds the latch end 192 of the pawl 180 in a "latched" position with respect to the free end 148 of the handle 22.

The cap head 172 is adapted, e.g. r grooved, channeled, slotted, etc., to receive the pawl 180 of the latch mechanism 178 such that in a static (i.e. locked condition), no part thereof extends beyond an exterior surface of the cap head 172 (FIG. 1 or FIGS. 5/6). As best seen with respect to FIG. 4, the cap head 172 includes a notch or break 193 in its perimeter (i.e., sidewall) for seating or otherwise receiving the latch end 192 of the pawl 180. The latch end 192 is dimensioned so as to exceed the "thickness" of the cap head 172 (i.e., the height of the sidewall) such that a portion thereof mates or cooperatively engages the free end 148 of the handle 22.

In furtherance of securing the end cap 156 in place, the handle 22 includes mating slots or notches 194 (i.e., castellations) into which the latch end 192 of the pawl 180 may be received so as to provide for positive engagement of the pawl 180 with the handle 22, thereby preventing the movement (i.e., rotation) of the end cap 156 in one direction, yet providing unrestricted movement in the other direction. More particularly, the mouth 170 of the lower compartment 152 of the handle 22 preferably includes spaced apart notches 194 (i.e., material has been removed so as to form a squared crown edge) for indexed receipt of the latch end 192 of the pawl 180 therein.

As the operator turns the end cap 156, the latch end 192 of the pawl 180 ratchets past/over the notches 194 of the free end 148 of the handle 22, until the operator stops turning the end cap 156, and the latch end 192 engages an aligned or registered handle notch or slot of the spaced apart notches or slots 194 (FIG. 5 or 6). Such engagement by the latch pawl 180 prevents the cap from being turned in a loosening direction inadvertently. The operator can be confident that the cap assembly will not disengage without specific intended action.

As previously noted, the lower compartment 152 of the handle 22 defines a stowage space 196 for the weapon grip assembly of the subject invention. The lower portion 154 of the inside of the handle 22 is hollow, and is preferably, but not necessarily, specifically contoured to provide additional functionality. The depth of the storage space 196 as well as the contour of the interior wall surface, within the lower compartment thereof, have been specifically sized to accommodate either two (2) AA batteries 198 (FIG. 5, solid line, and FIG. 10), or two (2) DL123 batteries 200 (FIG. 5, broken line). Other items, including but not limited to gum, cigarettes, matches, etc. also fit into the storage space 196 in lieu of batteries. A spring, more generally a biasing or resilient element 202, is further provided within the stowage space 196 to bias the compartment contents against the walls defining same. As should be readily appreciated, any content shifting is to be avoided, primarily to avoid rattling or other noise which would give away the user's position, motion or otherwise be a distraction.

Referring now specifically to FIGS. 5 & 6, there is illustrated the preferred embodiment of the subject weapon grip assembly 16 ready for affixation to a portion of a weapon (e.g. a grenade launcher, more particularly, a M203 40 mm launcher 28) and affixed to the weapon, respectively. As shown, the launcher 28 includes a barrel 72 attached to a receiver 73. A barrel handguard 30 substantially surrounds the launcher barrel 72 and cooperatively engages a portion of the receiver 73. The launcher handguard 30 has a characteristically "ribbed" exterior surface, i.e., the surface comprises a plurality of ribs or ridges 68 spaced apart by a plurality of flats 70. The grenade launcher barrel 72 further, characteristically, includes a handguard locator rivet 76, and a pair of cartridge retainer rivets 77 (FIG. 1).

Figure 11:
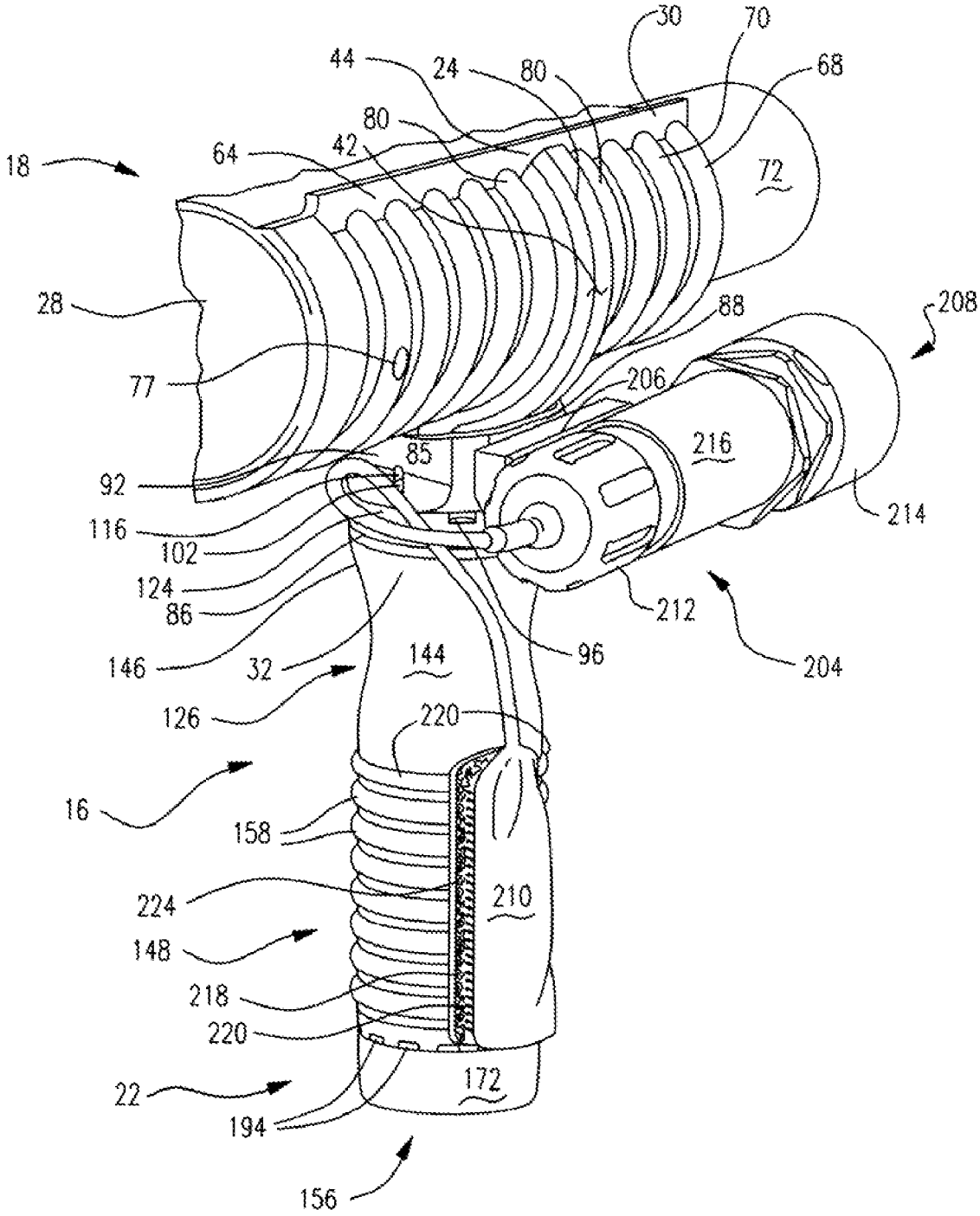
FIG. 11 is a perspective rear view of the weapon grip assembly of the subject invention, in combination with a grenade launcher, and equipped with an accessory, namely a flashlight assembly.

As previously discussed, a static or standby condition for the weapon grip assembly has the clamps or jaws 24 in a biasingly open position for receipt of the launcher barrel 72 (FIG. 5). In such condition, the handle 22 is minimally integrated with the base assembly 20, more particularly, the subassembly of the mandrel 32 and base assembly 20. As is readily appreciated by comparison of FIG. 5 with FIG. 6, the mandrel 32 of FIG. 5 has not yet been positioned to overcome the bias acting upon the clamps 24 to effectively pivot same for closure about the barrel 72 (FIG. 6). As the post 38 of the base assembly 20 is drawn into the handle 22, i.e., as the handle 22 is rotated clockwise thereabout, the mandrel 32 "rides" upwardly along with the handle 22 relative to the post 38, more generally, the base assembly 20, to operatively engage the clamps 24 for closure. As best seen in FIG. 11, the weapon receiving surface 26 of the clamp 24 receives a select rib 82 of the launcher handguard 30. The free end 44 of the clamp 24 meets up with (i.e., is positioned adjacent) the handguard 30 at its union with the receiver 73 such that rotation of the weapon grip assembly 16 about the barrel 72 is prohibited. Longitudinal motion (e.g., pivoting with respect to the launcher barrel length) is prohibited by the combination of an upper portion of the base assembly 20 and the inside contour 93 of the clamps (FIG. 7).

A key feature of the design of the preferred embodiment of the subject invention is to observe that once tightened, even lightly, it is impossible to pull the weapon grip assembly off the handguard of a weapon at angles near 90° because the open ends of the clamps wrap closely around the handguard, above its maximum diameter. This means that inward pressure need not be excessively exerted on the handguard to make the grip work (i.e., no vise-like clasping is necessary), only an "interference" fit of the clamps around the diameter of the handguard is necessary to prevent the weapon grip assembly from disengagement from the handguard. The tightness achieved by turning the handle is only used to force the grip clamps to remain close to the handguard contours in spite of being pulled by the operator in normal use. It's not about clamping down to grab, it's about just staying very close. The clamps will not let go unless they fail by spreading, the design and material of the clamps makes spreading virtually impossible within the range of pressures that can be exerted by a person handling and using the weapon system configured as FIG. 1.

Movement of the weapon grip assembly backward and forward (i.e., along the length of the handguard) is controlled by the combined, cooperative or associative fit of the mandrel 32 and the clamp end 40 of the post 38 with or to the handguard ribs 80 adjacent the rib 82 selected for capture by the jaws 24 (i.e., three consecutive handguard ribs are implicated in the attachment of the subject grip assembly, see FIG. 7).

Movement of the weapon grip assembly circularly around or about the handguard is controlled by the fit of the free end 44 of the clamps 24 to the vertical lip 64 of the handguard 30 (i.e., the handguard 30/receiver 73 interface). There is a calculated amount of play to allow for manufacturing tolerances of the handguard, tolerances of the grip, and for debris.

Figure 12:
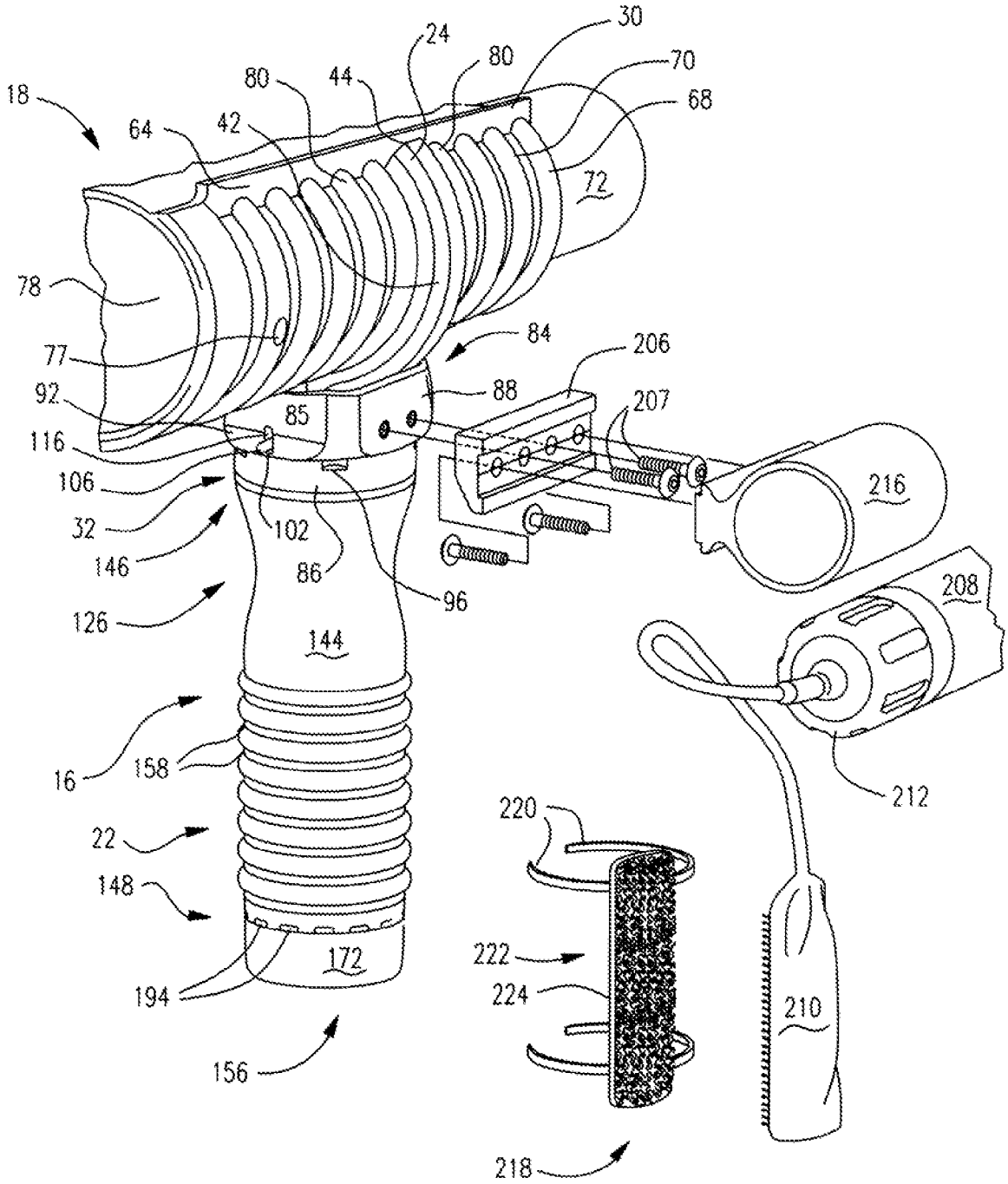
FIG. 12 illustrates the accessory of FIG. 11 in exploded view.

Referring now to FIGS. 11 & 12, the subject weapon grip assembly 16 is shown equipped with an accessory, namely a flashlight assembly 204. It should be understood that a variety of known accessory items including, but not limited to, a flashlight are advantageously supported or otherwise carried by the subject weapon grip assembly. In furtherance thereof, a channeled bracket 206 is contemplated for affixation, using threaded fasteners 207, to an exterior surface 85 of the upper portion 84 of the mandrel 32, more particularly, one of the opposingly paired primary walls 88 thereof. By this design, accessories may be mounted on either or both sides of the weapon grip assembly, at an operators preference.

In the instant case, the flashlight assembly 204 includes a flashlight 208 having a remotely operable power switch (i.e. a pad switch 210 tethered to an end cap 212 opposite a forward end 214 of the flashlight 208), a bracket 216 for integrating the flashlight 208 to the accessory bracket 206 affixed to the mandrel 32, and a spring clip 218 for retaining the pad switch 210 at the handle 22 of the weapon grip assembly 16. The spring clip 218 generally includes resilient members 220, extending from a base 222, which are conformingly received within the grooves 158 of the lower portion 154 of the handle 22. An exterior surface 224 of the base 222 of the spring clip 218 includes a portion of a hook and loop fastener system, or other reversible fixation means, so as to reversibly hold the pad switch 210 extending from the flashlight 208. As is readily appreciated with respect to FIG. 11, the weapon grip assembly provides advantageous location of the flashlight, and further provides advantageous positioning of the switch for supremely efficient and easy actuation of same and allows rotation of the handle of the grip assembly so as to remove same from the weapon without disassembly of flashlight assembly components (i.e., the switch).

Referring now only generally to FIGS. 13-16, there are shown alternate contemplated embodiments of the subject weapon grip. More particularly, FIGS. 13 & 14, as FIG. 4, illustrate a weapon grip assembly for reversibly securing a hand hold to a forward portion of a weapon, namely a handguard, whereas the device of FIGS. 15 & 16 includes an alternate clamp or jaw configuration, namely, a jaw which is readily received about a rail of a known rail adaptor system (RAS). It should be readily appreciated that the subject weapon grip may include (e.g., be provided with) alternate, interchangeable clamps or jaws in furtherance of offering device versatility which has become an important consideration of users of such weapons and or weapon systems. Again, the subject further embodiments are not intended to be in any way limiting or exhaustive of the further device styles, and/or features contemplated. It is again noted that like numerals are used to designate like parts.

Figure 13:
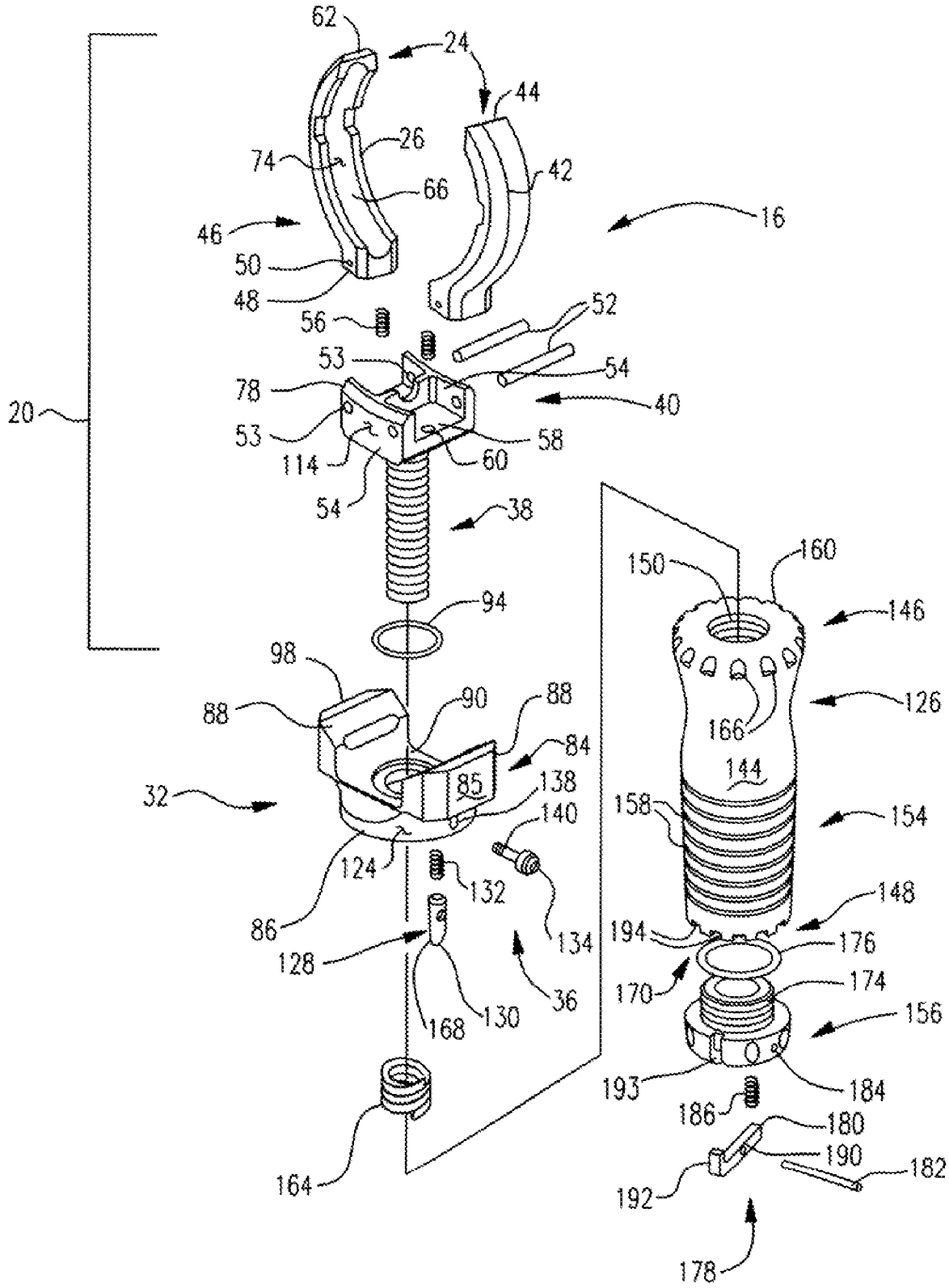
FIG. 13 is an exploded view, as FIG. 3, of an alternate embodiment of the subject invention; and, FIG. 14 is an exploded view, as FIG. 3, of a further embodiment of the subject invention illustrating, among other things, an alternate handle latching mechanism.

With regard to the device of FIG. 13, the alignment and retention mechanism 34 for the mandrel 32, relative to the base assembly 20 of the device of FIG. 4, has been omitted. Consistent with the omission, the mandrel 32 of the subject embodiment need not include an upper portion 84 having the secondary walls 92 of the previous embodiment (FIG. 4), instead, the upper portion 84 of the mandrel 32 need only include a single set of opposingly paired walls 88 (i.e., primary walls as previously discussed, again, note FIG. 4). The mandrel 32 is preferably shaped and sized to fit the profiles of the top end 146 of the handle 22, the clamp end 40 of the post 38, and the outside surface 42 of the clamps 24. The fit of the mandrel 32 to the handle 22 is sized to cover the entire top end 146 of the handle 22, and match its outer diameter with a smooth transition since an operator's hand is likely to be in contact with this area of the assembly. The underside of the lower portion 86 of the mandrel 32 is smooth, as it is intended to closely and tightly contact the top end 146 of the handle 22 when the weapon grip assembly is fitted to the barrel handguard.

Figure 9:
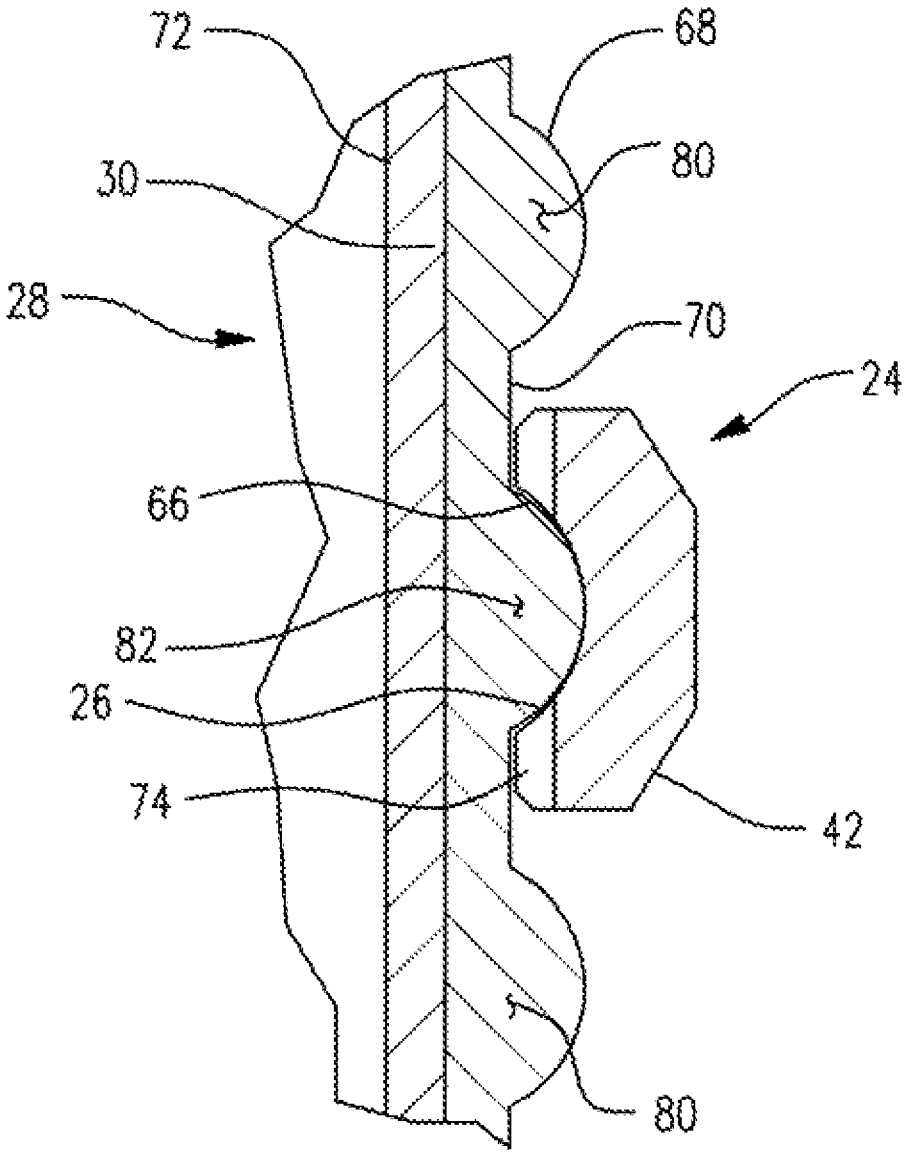
FIG. 9 is a section taken along lines 9-9 in FIG. 6 illustrating the interface of a clamp of the subject invention with the weapon handguard.
Figure 10:
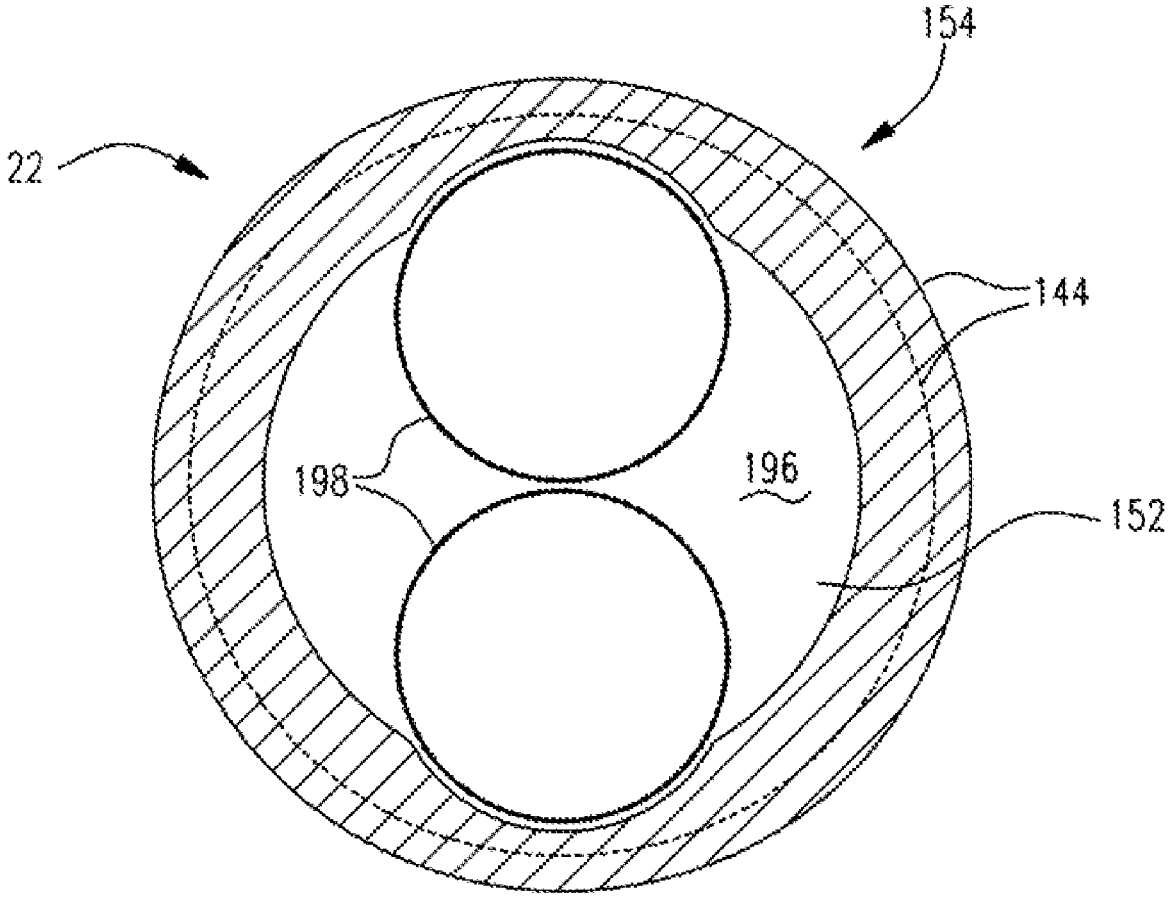
FIG. 10 is a section taken along lines 10-10 of FIG. 5 illustrating items housed within a stowage compartment of the handle.

As with the prior embodiment, the upper contoured edge or surface 78 of the clamp end 40 of the post 38, in combination with the clamps 24 themselves, effectively provide for an interference fit for the weapon grip assembly, namely, by partially encircling a select handguard rib 82, "filling" the flats 70 immediately adjacent the selected rib 82, and abutting the ribs 80 adjacent the select rib 82 (FIG. 9). The remaining structures of the device of FIG. 13, including their interrelationships, are readily appreciated by comparison with the FIG. 4, and reference to the discussion with respect thereto.

Figure 14:
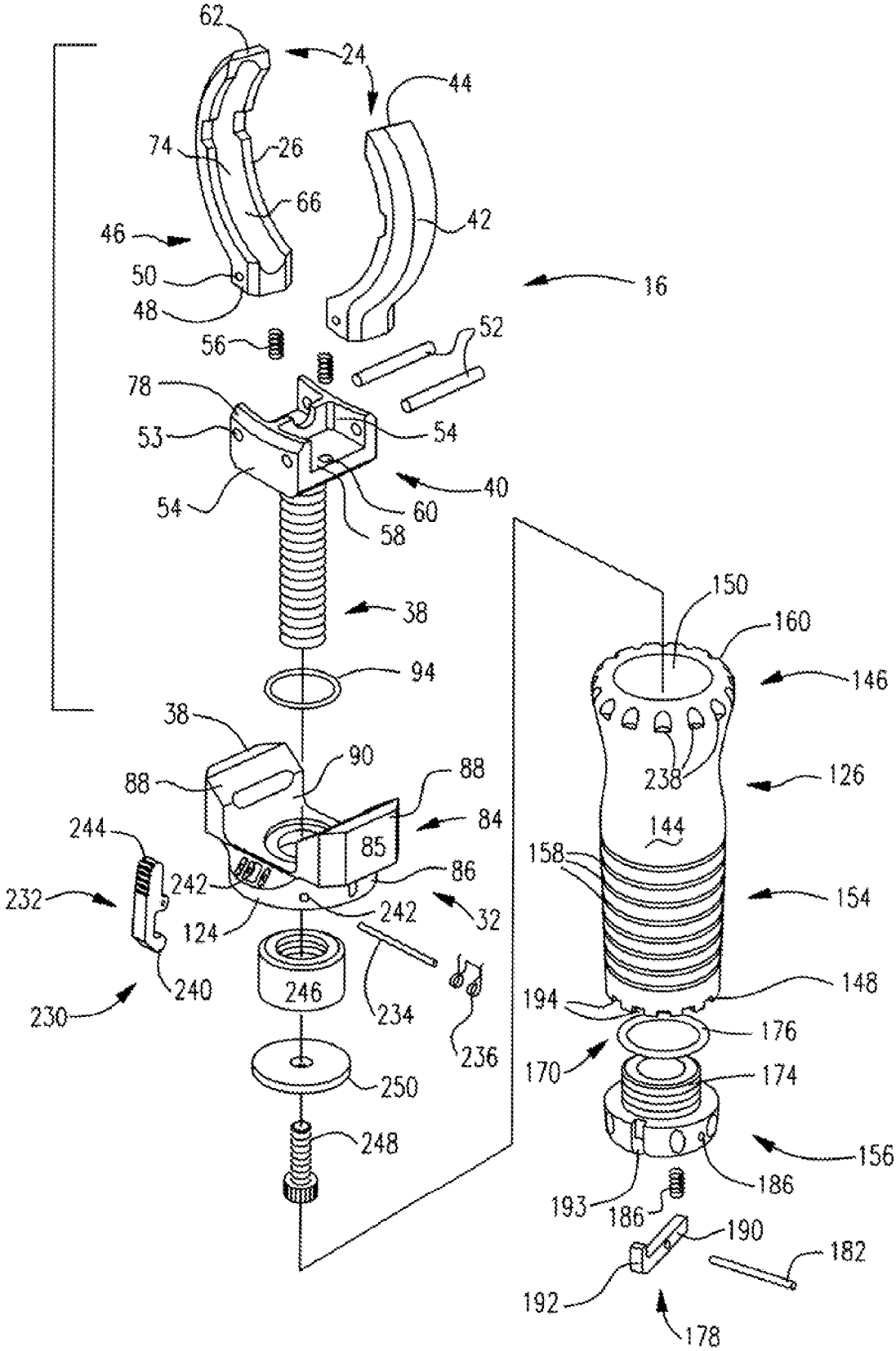

With regard to the device of FIG. 14, it too generally omits the alignment and retention mechanism 34 for the mandrel 32 (FIG. 4), and generally includes an upper mandrel portion as described with respect to the device of FIG. 13. In contradistinction to the embodiments previously detailed, the subject device includes an alternate latching assembly 230 for reversibly securing the subject weapon grip assembly to a weapon, and an alternate interface between or for the handle 22 and base assembly 20.

The mandrel 32 of the weapon grip assembly of FIG. 14, more particularly, a lower portion 86 thereof, incorporates a latching assembly 230 comprising a pawl 232, a pivot pin 234 and biasing spring 236. The hand grip or handle 22, at and about an upper end portion 126, incorporates mating slots 238 for a latch end 240 of the pawl 232. Receipt of the latch end 240 of the pawl 232 by a slot of the mating slots 238 the handle 22 provides positive engagement of the latching assembly 230, and the mandrel 32/base assembly 20 thereby, with the handle 22. Movement in one direction (i.e., a handle loosening direction) is prevented or thereby prohibited, whereas movement of the handle in the other direction (i.e., a handle tightening direction) is permitted or unrestricted.

The pawl 232 of the latching assembly 230 rotates around the pin 234 which is carried and retained by the mandrel 32, for instance, by fitting the pin 234 into a hole 242 in the lower portion 86 of the mandrel 32. The pawl 232 is biased by the torsion spring 236 wrapped around portions of the pin 234 (i.e., on both or opposite sides of the pawl 232). By the arrangement shown, the latch end 240 of the pawl 232 is held (i.e., biased) in the "latched" position (i.e., the latch end 240 of the pawl 232 pivots until received within a slot of the mating slots 238 of the handle 22).

As an operator turns the handle 22 of the weapon grip assembly, closing the clamps 24 around the launcher handguard 30, or other component of the weapon for clasping, the pawl 232 ratchets past the handle slots 238 until handle rotation ceases, the latch end 240 of the pawl 232 engaging the handle slot which most closely lines up or registers therewith. This engagement by the latch pawl 232 prevents the handle 22 from being turned in a loosening direction loosening. The operator can be confident that the system will not disengage without specific intended action.

To remove the handgrip, the operator depresses the upper exterior surface of the pawl 232, e.g., the knurled area 244 shown, against the spring pressure, while rotating the handle in the handle loosening direction. While depressed, the pawl 232 will allow unrestricted movement of the handle, upon release thereof, the pawl 232 will resume a position ready to re-lock the rotation of the handle against rotation in the handle loosening direction.

With regard to the interface of the subassembly comprising the combination of the mandrel 32 and base assembly 20 to or with the handle 22, the handle 22 preferably includes an aperture 150 (i.e., a bore) in a top surface 146 thereof. A steel threaded insert 246, which is sized to mate with the threaded post or stud 38 of the base assembly 20, is securingly received within the bore 150. Fastening means, e.g., a threaded fastener 248 in combination with a washer 250 as show, operatively unite the handle 22 to the subassembly, more particularly, the threaded fastener 248 is received within an axial bore of the post 38 which is threadingly received within the insert 246. The insert 246 assures that operators will not damage the grip handle 22 with the base assembly threaded stud 38 should the handle be over-tightened during attachment of the weapon grip assembly to the weapon. The depth of the handle bore 150 allows the stud 38 to be inserted into the handle 22 as needed for proper operation of the clamps 24.

As previously noted, the post 38 of the base assembly 20 is threaded to allow it to be drawn into the handle 22 by rotation thereof. This allows complete control of device attachment and detachment actions with only one hand. The thread pitch on the stud 38 has been specifically chosen such that it permits the operator to completely close the clamps around the barrel handguard, from a clamp opening width wide enough to fit over the handguard rib, in about one turn of the handle. This is advantageous so as to allow easy and quick operation. The imparted pitch also allows the handle to be tightened by the strongest operator without fear of stripping the threads, while retaining the tightness set by the operator without the need for a locking mechanism.

The base threaded stud 38 preferably has a keyway, not shown, running the length thereof. The keyway allows accessory fittings, attached or attachable to the device upon a bracket received upon the post 38, to maintain a proper alignment independent of the handle position or motion (e.g., it allows a flashlight or aiming laser bracket to remain pointed "forward" at all times while the handle 22 is rotated). Such bracket can be used so as to position an accessory on either lateral (i.e., left or right) surface of the handle, and more than one bracket can be stacked so that ancillary or accessory equipment can be used on both the right and left sides simultaneously.

Referring now to FIGS. 15 & 16, there is illustrated portions of a further embodiment of the subject weapon grip, namely, clamps 324 for grasping a rail 325 of a RAS. As a preliminary matter, the clamps or jaws supporting structures of FIG. 15 are generally as indicated and previously discussed with respect to FIG. 5, and the jaw supporting structures of FIG. 16 are generally as indicated and previously discussed with respect to FIG. 4. It should be understood that while the weapon grip of FIGS. 15/16 is preferably a stand alone, dedicated device, the rail receiving jaws 324 may be optionally provided (i.e., packaged or bundled) as part of, or with, one of the previously presented embodiments so as to easily and reversibly convert, in the field as may be advantageous and or necessary, from a grenade launcher grip configuration into a RAS grip configuration.

The subject embodiment of the weapon grip is characterized by opposingly paired jaws 324 (i.e., clamping jaws), each of which has a profiled surface 327, namely, a profiled lateral surface (FIGS. 15 and 16). The jaws 324 are arranged upon a clamp base 329 (i.e., the clamp end 40 of the post 38 of the clamp base 329) such that the profiled surfaces 327 thereof are in opposition: as the clamps 324 are drawn together, a rail receiving surface or volume is formed within which a rail of the forward portion of the weapon is captured (FIG. 15). With the actuatable jaws 324 adapted to receive a lateral edge 331 of the rail of a RAS, and thereby in unison grasp the rail, supremely fast secure placement of the grip anywhere along the rail length is achievable, with no removal from the rail of already present accessories so as to slidingly position heretofore known grips.

The RAS jaws 324, as the launcher receiving jaws (FIG. 4), are joined to the clamp base 329 via pin 52 which traverses opposing upstanding wall segments 54 of the clamp end 40 of the post 38 of the clamp base 329 via a set of paired and aligned thru holes 53, thereby securing the clamp 324 to the post 38. The clamp pin defines a pivot axis for each of the clamps.

A compression spring 56, one for each of the clamps 324, is seated so as to be interposed between an exterior surface of a base thereof, and a surface 58 from which the opposing upstanding wall segments 54 of the clamp end 40 of the post 38 extend (i.e., a "floor" of the clamp receiving "space," note also FIGS. 4 and 5/6). In the static condition for the weapon grip assembly (FIG. 15), the springs 56 bias each of the clamps 324 (i.e., impart a force upon the base end 46 of the clamp 324) such that the clamps 324 are "open," in readiness for capturing a portion of the weapon. The biasing effect of the springs 56 upon the clamps 324 is negated, or more generally regulated, to the point where the springs 56 are compressed and the free ends 44 of the clamps 24 secured about the rail, by the mandrel 32, more particularly its implication in the jaw actuation process. More particularly, the range of pivot motion of the jaws is regulated or limited, at least indirectly, by the mandrel: being interposed between the top of the handle and the jaws and received about the post of the clamp base, as previously discussed, the mandrel "rides" the post of the clamp base as it is drawn into the axial bore of the handle during rotation of the handle relative to the clamp base.

As previously discussed with reference to FIG. 7, alignment and retention mechanism 34 (FIG. 16) of the subject invention ensures proper positioning and thus functioning of the mandrel 32 on the post 38 (FIG. 15) while limiting the range of vertical or axial travel with respect thereto, such that the primary walls 88 of the upper portion 84 of the mandrel 32 are at all times positioned to underlay and ultimately engage the clamps 24 of the base assembly 20.

There are other variations of the subject invention, some of which will become obvious to those skilled in the art. It will be understood that this disclosure, in many respects, is only illustrative. Changes may be made in details, particularly in matters of shape, size, material, and arrangement of parts, as the case may be, without exceeding the scope of the invention. Accordingly, the scope of the subject invention is as defined in the language of the appended claims.

What is claimed is:

1. Apparatus for facilitating support of a weapon forend, the apparatus comprising a handle, a collar, and a base assembly extending from said handle, said base assembly comprising paired clamp segments and a post having a clamp end adapted to pivotably retain each clamp segment of said paired clamp segments, said collar interposed between said handle and said clamp end of said post of said base assembly, said post receivable through said collar for cooperative engagement with said handle such that said clamp end of said post is reversibly drawn into said collar, said paired clamp segment thereby pivotably actuated in furtherance of selective affixation to the weapon forend.

2. The apparatus of claim 1 wherein said collar is adapted to operatively support an auxiliary device.

3. The apparatus of claim 1 wherein said collar is adapted to operatively support a target illumination device.

4. The apparatus of claim 1 wherein each clamp segment of said paired clamp segments is curved throughout a length thereof.

5. The apparatus of claim 1 wherein each clamp segment of said paired clamp segments includes a profiled weapon receiving surface.

6. The apparatus of claim 1 wherein each clamp segment of said paired clamp segments is adapted for receipt of a rib of a handguard of the weapon forend.

7. The apparatus of claim 1 wherein each clamp segment of said paired clamp segments includes a profiled rail receiving surface.

8. The apparatus of claim 1 wherein said collar is equipped with components of a latching assembly so as to rotationally secure said handle upon said post of said base assembly.

* * * * *